US007340203B2

(12) United States Patent
Höllig et al.

(10) Patent No.: US 7,340,203 B2
(45) Date of Patent: Mar. 4, 2008

(54) METHOD AND DEVICE FOR CLEANING SUPPORT ELEMENTS IN PRINTERS OR COPIERS BY MEANS OF MAGNETIC FIELDS

(75) Inventors: Uwe Höllig, München (DE); Peter Schulmeister, Pfaffenhofen (DE); Ralf Selinger, München (DE); Volkhard Maess, Pliening (DE)

(73) Assignee: Oce Printing Systems GmbH, Poing (DE)

( * ) Notice: Subject to any disclaimer, the term of this patent is extended or adjusted under 35 U.S.C. 154(b) by 253 days.

(21) Appl. No.: 10/493,724

(22) PCT Filed: Oct. 25, 2002

(86) PCT No.: PCT/EP02/11953

§ 371 (c)(1),
(2), (4) Date: Oct. 12, 2004

(87) PCT Pub. No.: WO03/036393

PCT Pub. Date: May 1, 2003

(65) Prior Publication Data

US 2005/0036806 A1 Feb. 17, 2005

(30) Foreign Application Priority Data

Oct. 26, 2001 (DE) ..... 101 52 892

(51) Int. Cl.
*G03G 15/09* (2006.01)

(52) U.S. Cl. ..... 399/273; 399/270; 399/274

(58) Field of Classification Search ..... 399/356, 399/349, 273, 282, 283, 274, 284, 270

See application file for complete search history.

(56) References Cited

U.S. PATENT DOCUMENTS

| | | | | |
|---|---|---|---|---|
| 4,141,165 | A | 2/1979 | Dichter et al. | |
| 4,142,165 | A | 2/1979 | Miyakawa et al. | |
| 4,325,628 | A * | 4/1982 | Torigai et al. | 399/356 |
| 4,383,497 | A | 5/1983 | Tajima | |
| 4,470,694 | A | 9/1984 | Murakami et al. | |
| 4,482,244 | A | 11/1984 | Yamazaki et al. | |
| 4,500,196 | A | 2/1985 | Shimura | |
| 4,771,311 | A * | 9/1988 | Bray | |
| 5,003,354 | A | 3/1991 | Takamiya et al. | |
| 5,182,601 | A * | 1/1993 | Hodoshima et al. | |
| 5,223,669 | A | 6/1993 | Kanba et al. | |
| 6,266,507 | B1 | 7/2001 | Nagahama et al. | |

FOREIGN PATENT DOCUMENTS

| | | |
|---|---|---|
| DE | 32 49 767 | 3/1983 |
| DE | 32 41 819 C2 | 5/1983 |

(Continued)

*Primary Examiner*—Susan Lee
(74) *Attorney, Agent, or Firm*—Schiff Hardin LLP

(57) ABSTRACT

The invention relates to a method and devices for cleaning the surfaces of applicator rollers, photoconductor drums, transfer belts, and photoconductor belts using magnetic roller systems. The invention also relates to methods and systems for cleaning magnetic rollers to whose surfaces toner particles adhere. In a first embodiment, a squeegee/scraper is disposed at a distance to the surface of the roller. In another embodiment, a magnetic stator configuration with two spaced apart magnetic elements is used whose poles have substantially the same active direction.

43 Claims, 13 Drawing Sheets

FOREIGN PATENT DOCUMENTS

| | | | | |
|---|---|---|---|---|
| DE | 32 46 940 | A1 | | 8/1983 |
| DE | 39 40 079 | A1 | | 6/1990 |
| DE | 39 40 079 | C2 | | 6/1990 |
| DE | 41 05 262 | A1 | | 8/1991 |
| DE | 41 05 261 | A1 | | 8/1992 |
| JP | 56101168 | A | * | 8/1981 |
| JP | 57092365 | A | * | 6/1982 |
| JP | 58 055 960 | A | | 4/1983 |
| JP | 60229082 | A | * | 11/1985 |
| JP | 61248074 | A | | 11/1986 |
| JP | 63 281 186 | A | | 11/1988 |
| JP | 04070890 | A | * | 3/1992 |
| JP | 05 289 523 | A | | 4/1992 |
| JP | 04 163 479 | A | | 6/1992 |
| JP | 2000035736 | A | | 2/2000 |
| JP | 2000267397 | A | | 9/2000 |

* cited by examiner

METHOD AND DEVICE FOR CLEANING SUPPORT ELEMENTS IN PRINTERS OR COPIERS BY MEANS OF MAGNETIC FIELDS

BACKGROUND OF THE INVENTION

The invention concerns an electrophotographic print or copy device in which a toner application unit applies electrically charged toner particles to the surface of a first carrier element. At least one part of the applied toner particles is transferred from the first carrier element to a second carrier element. A cleaning unit removes remaining toner particles from the first carrier element. A further aspect of the invention concerns a device to clean a roller of toner particles in an electrophotographic printer or copier, on whose surface is conveyed a particle mixture made up of electrically charged toner particles and ferromagnetic carrier particles. Furthermore, methods to operate an electrophotographic printer or copier and to clean a roller in an electrophotographic printer or copier are specified.

In electrophotographic printers or copiers, image development methods are used that develop electrostatic charge images on surfaces (for example, charge images on a photoconductor) over an air gap or in direct contact with triboelectrically charged toner that is located on a surface of an applicator element. Such an applicator element can, for example, be implemented as a roller or as a continuous band. The toner particles are triboelectrically charged before the transfer to the applicator element. In known printers or copiers, a two-component mixture made of toner particles and ferromagnetic carrier particles is generated. The two-component mixture is mixed in the printer or copier such that the toner particles rub on the carrier particles, whereby they are triboelectrically charged.

It is known to ink surfaces with toner particles that are comprised in a two-component mixture. A magnetic roller arrangement transports the two-component mixture in an area with slight separation between the magnetic roller arrangement and the surface to be inked, whereby a magnetic field of a magnet element acts on the two-component mixture. In this area, a magnetic brush is fashioned that comprises carrier particles and toner particles, whereby only the latter is transferred to the surface to be inked. The carrier particles are held back due to the magnetic field.

In other known printers or copiers, the transfer of the toner particles from the magnetic roller arrangement to the applicator element ensues over an air gap between the magnetic roller and the applicator element that is not completely bridged by the accumulation of the two-component mixture. The transfer of the toner particles to the applicator element surface can be supported by an auxiliary transfer voltage, meaning by a potential different between magnetic roller and applicator element.

During an image development event, the toner is transferred via an air gap or via direct contact from the applicator element surface to the surface bearing a charge image (for example, to the surface of a photoconductor drum or a photoconductor band), corresponding to a charge distribution of a latent charge image. Corresponding to the latent charge image, toner particles remain on the surface of the applicator element in the form of an image negative of the developed charge image. The toner particles remaining on the applicator element must be removed from the applicator element before a new application of a closed homogenous toner layer on the applicator element. The unprinted surface of a print page with text is approximately 95% of the total surface. Given printing of such an average print page, approximately 95% of the toner particle quantity applied to the applicator element must thus be removed from it. Depending on the type of print image to be inked, 0 to 100% of the toner particle quantity must be removed from the applicator element.

In print systems with high print speed, the cleaning of the applicator element only insufficiently ensues with the aid of known cleaning devices. After multiple applications of toner particles on the applicator element, and after incomplete cleaning of the toner particles remaining on the applicator element after the inking of the latent charge image, these form a non-uniform thick layer on the applicator element. The inhomogeneous toner layer of different thickness can cause print image interferences, such as "memory effect". Given memory effect, the preceding print image is visible in inked regions of the print image as a result of the inhomogeneous toner layer on the applicator element that is transferred as a print image onto a medium to be printed. For a qualitatively high-grade print, a complete removal of the remaining toner particles is therefore necessary before the new application of toner onto the applicator element.

If, given a photoconductor drum, the latent charge image is developed, meaning inked with toner particles corresponding to the charge distribution, and the toner image is transfer printed onto a carrier material, some residue of the toner image remains on the surface of the photoconductor drum. This toner residue must be removed from this before the new application of a latent charge image on the photoconductor drum.

It is likewise necessary in print or copy devices to remove toner particles from photoconductor bands, transfer bands and magnetic rollers in order to not affect the electrophotographic process and to ensure a high print quality.

In known print or copy devices, the cleaning (meaning the removal of toner residues) of photoconductor drums ensues with the aid of plastic brushes that have direct contact with the surface of the photoconductor drum. Wear thereby ensues both on the plastic brushes themselves and on the photoconductor drum. Furthermore, the toner particles to be removed are subject to a significant mechanical stress during the cleaning process with such brushes, whereby the physical properties of the toner particles are negatively changed.

From U.S. Pat. No. 4,383,497, an arrangement for cleaning an applicator element is known in which the toner particles are mechanically stripped from the applicator element with the aid of a stripping blade that is in direct contact with the surface of the applicator element. The toner particles are thereby mechanically significantly stressed, meaning high mechanical pressure and shear forces are exerted on the toner particles. The mechanical stress of the toner particles leads to a negative change of the physical properties, or even to a loss of functionality of the toner material, whereby print image interferences can ensue given a reuse of these toner particles to develop subsequent print images. Such blades are, for example, produced from plastic, metal or from metal coated with ceramic. The direct contact between blade and applicator element above all effects a high wear in the blade. The wear is different in regions of the blade, whereby a non-uniform cleaning of the structure element ensues given a worn blade. This blade must be exchanged frequently in high-capacity printing systems. Moreover, the surface of the applicator element can be damaged by the mechanical friction between blade and applicator element. Such damage can altogether impair the function of the applicator element.

From German Patent Document DE 41 05 261 A1, an image generation device with two identical image generation units is known. A first image generation unit is arranged in a development position and operates as a development unit. The second image generation unit is arranged in a cleaning position and operates as a cleaning unit. The image generation units are alternatively and repeatedly brought into the development position and the cleaning position. The particle mixture comprised in an image generation device is thereby used for application of toner material and, at another point in time, for cleaning.

From U.S. Pat. No. 4,141,165, an electrostatic copier is known in which magnetic brushes are used to ink a charge image of a photoconductor drum and to remove residual toner from the photoconductor drum. A roller that internally comprises stationary magnets is used for application and cleaning. The magnetic brushes are generated with the aid of the magnets. A particle mixture is removed from the surface of the roller with the aid of scrapers whose edges scrape on the surface of the roller.

A magnetic brush cleaning device for a copy device is known from German Patent Document DE 32 46 940 A1. With the aid of a magnetic brush device, it is achieved that a mixture made of a magnetic carrier and the toner glides over the surface of a photoconductor and absorbs toner residue adhering to the photoconductor surface. The cleaned toner is supplied with the aid of a toner recovery device that comprises a plurality of rollers. Toner material adhering to the rollers of the toner recovery device is removed from these with the aid of scrapers scraping on the rollers.

From German Patent Document DE 32 41 819 C2, a magnetic brush cleaning device is known in which a cleaning roller is provided in which internal stationary magnets are provided that generate magnetic brushes. The magnetic brushes slip over the surface of a photoconductor drum and clean off residual toner from it that remains after the transfer printing of a toner image on the control device. The cleaned-off toner material is transferred from the magnetic roller to a second roller. With the aid of a stripper that lies on the surface of the second roller, the toner material is scraped from the surface of the second roller.

From Japanese Patent Document JP 2000267397 A, magnetic rollers are known that are used to ink a charge image of a photoconductor drum and to clean off residual toner from the photoconductor drum. Two abutting magnet elements that are arranged opposite the surface of the photoconductor drum prevent the contact of the magnetic brushes with the surface of the photoconductor drum. The magnets of the magnetic roller rotate with the magnetic roller.

From German Patent Document DE 32 49 767, a cleaning device is known for the removal of developer particles from an imaging surface of a moving, photoconductive band in an electrophotographic copier device. The back side of the band is also cleaned of possible toner residues and dust deposits with the aid of this cleaning device. The band is pressed against a cleaning roller with the aid of a stripper. Via magnets arranged in the cleaning roller, the stripper is pressed against the cleaning roller by means of a plate made from a magnetizable material.

From German Patent Document DE 39 40 079 C2, a method is known to remove a thin layer from a movable photoconductive part of an image generation device. Toner material that is located on a roller surface is thereby removed with the aid of a stripper that scrapes the toner material from the roller surface.

SUMMARY OF THE INVENTION

It is the object of the invention to specify electrophotographic print or copy devices, as well as methods for operation of electrophotographic print or copy devices, in which a high print quality is achieved, whereby a low stress of the particle mixture made of ferromagnetic carrier particles and electrically charged toner particles ensues. Furthermore, devices and methods are specified for cleaning a roller in an electrophotographic printer or copier that ensure a maintenance-free operation of the devices for cleaning.

This object is achieved for an electrophotographic print or copy device with the features as described below.

Various embodiments of the invention are described in the following paragraphs. With the aid of an embodiment of the inventive device, toner particles applied to the surface of a roller of an electrophotographic printer or copier are reliably removed with little effort. Inside the roller, two magnet elements are arranged stationary, of which respectively one pole is directed towards the roller surface such that they act approximately in the same direction. Viewed in the rotation direction of the roller, the magnet elements are arranged at a distance from one another such that the carrier particles remain on the magnet elements, and raised accumulations (what are known as "magnetic brushes") form, whereby, given a rotation movement of the roller, the carrier particles rub on its surface. The cleaning device reliably removes the toner particles adhering to its surface and requires no additional space in the electrophotographic printer or copier since the magnet elements are arranged inside the roller.

The device operates without wear and effects an additional triboelectric charge of the toner. Additional energy is not required to operate the device. Furthermore, the device is suitable for various particle mixtures made of up toner particles and carrier particles. The cleaning also reliably ensues given a change of the physical properties of a particle mixture used in a print or copy device. With increasing duration of use, such changes ensue via mechanical stress of the toner particles.

The adjacent poles of both magnet elements facing the particle mixture are similar, meaning the magnetic fields of these poles act in approximately the same direction, such that a low field strength is present between the magnet elements on the roller surface. The field vectors of the magnetic fields have an opposite sense of direction in this region on the roller surface, such that no resulting field strength is present there given approximately uniform magnet elements. The particle mixture on the roller surface remains on the magnet elements and forms raised accumulations in which a rotating roller-shaped movement is generated within the particle mixture given a rotation movement of the roller. Given this motion, the particle mixture abrades the toner particles adhering to the roller surface.

In an advantageous embodiment of the device, the magnet elements are arranged such that at least one part of the carrier particles in a sub-region between the two magnet elements is loosened from the roller surface by the force of the magnetic fields of the magnet elements acting on the carrier particles, whereby the particle mixture is particularly well swirled in the region of the magnet elements given a rotation movement of the roller. It is thereby achieved that toner particles that are located on the roller surface are loosened from this and completely rubbed off, whereby the mechanical stress of the particle mixture is low. The physical properties of the particle mixture remain the same. In this embodiment, the toner particles electrostatically applied to the outer circumferential surface of the roller can be particularly effectively removed. Given a rotation movement of the roller, carrier particles are conveyed back in the areas on the roller surface, whereby a part of the particle mixture remaining in these areas is also conveyed. The abraded toner particles are also transported away with this particle mixture, such that an exchange of the remaining particle mixture ensues.

It is also advantageous to align the axes of the poles of the magnet elements radially relative to the rotation axis, since a maximal field effect of the magnet elements arranged in a static manner (i.e., stationary) inside the roller is thereby achieved on the carrier particles.

In another embodiment of the invention, in addition to the magnet elements, a scraper is arranged at a predetermined separation from the roller surface. It is thereby advantageous to arrange the scraper in the rotation direction of the roller after the first and second carrier element, near the second magnet element. It is also advantageous to arrange the scraper in the lower roller half. The swirling of the particle mixture to abrade the toner particles from the surface of the roller, and the separation of the particle mixture from the roller surface, ensues effectively and with low design cost via the arrangement of the scraper.

In another advantageous embodiment, the outer circumferential surface of the roller has a roughness in the range of 1 to 5000 μm. The roughness of the roller surface can be cost-effectively produced with a high quality via flame spraying, whereby a layer is generated that comprises aluminum, chromium, nickel, copper, conductive plastic and/or a plastic with a conductive layer. The surface of the roller can thereby be charged with a set potential in order to, for example, support the transfer of toner particles onto this roller or from this roller. Rollers and surfaces can also be produced from these materials simply and cost-effectively.

It has proven to be particularly advantageous to arrange the adjacent edges of both magnet elements at a distance in the range of 0.01 to 10 mm, since a particularly thorough cleaning ensues at this distance. This distance range is, however, dependent on the field strength of the magnet elements used, on the circumferential speed of the roller, on the particle mixture used, most of all on the carrier particles used, and on the distance between the magnet element and the outer circumferential surface of the roller. The cleaning device can be simply adapted to the operating conditions of the printer or copier by changing the distance between the magnet elements and/or by the use of magnet elements with other field strengths.

The roller used in this cleaning device can comprise further magnet elements to generate particle accumulations, what are known as magnetic brushes, on the roller surface. In further advantageous embodiments, the magnet elements are permanent magnets. This is particularly advantageous since, in contrast to electromagnets, no auxiliary energy is necessary for permanent magnets.

A thorough and wear-free cleaning of the roller ensues via an inventive method to clean a roller in an electrophotographic printer or copier. No further additional aggregates are necessary for cleaning, whereby no additional space for the cleaning device is needed for cleaning. The toner particles are additionally triboelectrically charged by the cleaning process. The cleaning of the roller ensues almost without wear.

A second aspect according to an embodiment of the invention concerns an electrophotographic print or copy device as well as an inventive method to operate an electrophotographic print or copy device. A first carrier element is inked with toner, whereby this carrier element is subsequently cleaned of toner residues with the aid of a roller arrangement of a cleaning unit. The toner residues are removed from this roller arrangement with the aid of a scraper magnet element arrangement. It is thereby prevented that toner particles are permanently applied to the surface of the roller arrangement and form a crust-like layer that prevents electrostatic effects, and thus impairs the electrophotographic process. In the inventive device, and given the inventive method, the electrophotographic print or copy event can be implemented in high quality and with high speed. Such an electrophotographic print or copy device can be cost-effectively produced via the simple, compact design.

According to a third aspect according to an embodiment of the invention, a device is specified for cleaning a roller in an electrophotographic printer or copier. This device has a scraper that is arranged at a distance from the surface of a roller on whose roller surface is conveyed a particle mixture made up of carrier particles and electrically charged toner particles. A magnet element is statically (i.e., stationary, with regard to the scraper) arranged inside the roller, such that the carrier particles in the area (viewed in the rotation direction of the roller) before the scraper form a raised accumulation, i.e., a magnetic brush, on the roller surface. Given a rotation movement of the roller, the carrier particles of the accumulation abrade on its surface. Via this device, it is simply possible to achieve a high degree of cleaning of the roller to be cleaned. Such a device is simple and cost-effective to produce. The wear of the cleaning elements and the roller have been significantly reduced with regard to known cleaning devices for rollers.

In another embodiment of the invention, the scraper strips off at least one part of the particle mixture located on the roller. The magnetic field of the magnet element holds parts of the particle mixture stripped by the scraper in the area in front of the scraper. Via the rotation movement of the roller and via the scraper in a fixed position, the particle mixture is swirled in the area in front of the scraper.

It is thereby achieved that toner particles that are located directly on the roller surface are also mechanically abraded from the surface of the roller, primarily via the swirling of the carrier particles. The abraded carrier particles are absorbed by the particle mixture in the area in front of the scraper. Carrier particles that are located directly on the surface of the roller are thereby also loosened by these and can thus be effaced. The negative change of physical properties of the roller via a crust-like layer made of toner particles on the roller surface is thus simply and cost-effectively prevented. A layer made of toner particles on the roller surface has an electrically insulating effect and limits the effect of a potential difference between the roller surface and further elements such as further rollers and bands of the printer or copier, the use of the abraded carrier particles prevents this effect. Such potential differences are, for example, used to transfer electrically charged toner particles in printers or copiers.

Furthermore, it is advantageous to align the axes of the poles of the magnet element radially relative to the rotation axis of the roller arrangement. There are thereby areas with higher magnetic field strength in which raised accumulations made of toner particles and carrier particles form on the surface of the roller. It is also advantageous to arrange in a stationary manner a plurality of magnet elements inside the roller. The axes of the poles are respectively radially aligned, whereby the poles of neighboring magnet elements are aligned approximately opposite. It is thereby achieved that a strong magnetic field is generated between neighboring magnet elements.

If, in another embodiment, the scraper is arranged in the lower roller half, the particle mixture can simply fall down onto the scraper. The transportation of the particle mixture away onto the scraper is thus simply possible. The particle mixture falling down can, for example, be collected in a catch reservoir arranged under the roller, or fall directly into what is known as a mixture sump of the printer or copier in which the two-component mixture is located, and subsequently can be supplied again to the electrophotographic print or copy process.

In a further embodiment, the outer circumferential surface of the roller has a roughness in the range of 1 to 5000 μm. It is thereby achieved that the particle mixture to be transported onto the roller surface has an adhesion sufficient for the transport, and that the particle mixture can be removed again from the surface in a simple manner. Additionally or alternatively, the surface roller can be profiled in order to reduce a slip of the particle mixture on the roller surface and to ensure a continuous transport of the particle mixture given a rotation movement of the roller.

It is advantageous to generate the surface of the roller with the aid of a flame spray method. With the aid of the flame spray method, a surface of the roller can be simply and cost-effectively produced with a suitable roughness. If the roller surface and/or at least one part of the rotating hollow roller is produced from aluminum, chromium, nickel, copper, conductive plastic and/or a plastic with a conductive layer, the surface of the roller can be charged with a set potential in order to, for example, support the transfer of toner particles onto this roller or from this roller. Rollers and surface can also be produced from these materials simply and cost-effectively.

In an advantageous development of the invention, the distance between scraper and roller surface is set in the range of 0.05 to 6 mm. Such a distance ensures a low wear of scraper and roller as well as a reliable cleaning of the roller toner particles fixed on the roller surface.

Via the inventive method for cleaning a roller in an electrophotographic printer or copier, it is achieved that the cleaning of the roller thoroughly ensues with little effort. Additional auxiliary energy is not necessary for this. Furthermore, a compact design of the printer or copier is possible with the aid of the method, whereby the method can be implemented almost without wear for the roller and for the scraper via the separation between scraper and roller surface. This method for cleaning the roller can be used for various particle mixtures made up of toner particles and carrier particles. The cleaning effect of such an arrangement also persists when the physical properties of the particle mixture change.

A fourth aspect according to an embodiment of the invention concerns a electrophotographic print or copy device in which a toner application unit applies electrically charged toner particles to the surface of a first carrier element. At least one part of the toner particles is transferred from the first carrier element to a second carrier element. A cleaning unit removes from the first carrier element the toner particles remaining on the first carrier element after the transfer, The cleaning unit comprises a roller that is arranged at a distance from the first carrier element. At least two magnet elements are arranged in a stationary manner inside the roller. A particle mixture that comprises electrically charged toner particles and ferromagnetic carrier particles is conveyed on the surface of the roller. The adjacent poles of both magnet elements facing the particle mixture are uniformly (viewed in the rotation direction of the roller) arranged at a distance relative to one another, such that the carrier particles on the surface of the roller form at the magnet elements at least one accumulation whose carrier particles, given a rotation movement of the roller, abrade on its surface.

With the aid of the inventive electrophotographic print or copy device, and given a method to operate this electrophotographic print or copy device, it is possible with little effort to produce qualitatively high-grade print images in a simple manner, whereby the mechanical stress of the toner is relatively low. Via the cleaning of the first carrier element and the roller arrangement used for cleaning, a qualitatively high-grade print image is also ensured given longer use of the print or copy device, whereby toner particles that adhere to the surface of the roller are abraded from this via a magnet element arrangement by the particle mixture on the surface of the roller. It is thereby prevented that toner particles on the surface of the roller are permanently applied, hinder the electrostatic events, and thus impair the electrophotographic process. The physical properties of the roller arrangement and of the toner mixture can be kept constant over a large span of time via the device or the method.

In an advantageous embodiment, a scraper is arranged stationary at a predetermined distance from the roller surface in the area of the second magnet element or, viewed in the rotation direction of the roller, after the two magnet elements. The roller-shaped movement within the particle mixture made up of carrier particles and toner particles in the region of the magnet elements on the roller surface is intensified by the scraper, whereby in the area in front of the scraper, at least parts of the toner particles that have stuck to the roller surface are abraded and loosened from this.

A fifth aspect according to an embodiment of the invention concerns an electrophotographic print or copy device as well as a method to operate such an electrophotographic print or copy device. The electrophotographic print or copy device has a toner application unit that transfers toner particle onto a first carrier element with the aid of a particle mixture made up of electrically charged toner particles and ferromagnetic carrier particles. After the transfer of at least one part of the toner particles of the particle mixture, the particle mixture is supplied to a second carrier element of a cleaning unit. With the aid of the supplied particle mixture, the cleaning unit absorbs the toner particles present on the first carrier element.

In an embodiment of the invention, an applicator element is used as a first carrier element and a photoconductor is used as a second carrier element. It is thereby achieved that the applicator element is inked with toner particles with the aid of the toner application unit, whereby a part of the toner particles are transferred from the applicator element onto the photoconductor, corresponding to the latent charge image located on the photoconductor, and the toner particles remaining on the applicator element are removed from this. A uniform layer thickness of the toner particles of the print image is ensured via the combination of the applicator element and the photoconductor, whereby qualitatively high-grade, homogenous print images are generated with a uniform print intensity.

In another development of the invention, the first carrier element is a photoconductor and the second carrier element is a carrier material to be printed or a transfer element. The photoconductor is inked with toner particles corresponding to its latent charge image and the toner image is transfer printed onto the carrier material to be printed or the transfer element. The toner particles remaining after the transfer printing onto the photoconductor are removed from the photoconductor with the aid of the cleaning unit. It is thereby achieved that the photoconductor is completely cleaned of toner particles after a print or copy event, before a further print or copy event, and memory effects are prevented in the subsequent print image.

In a further embodiment of the invention, the rotation direction of the roller is the same as the rotation direction of the first carrier element. With regard to an opposite rotation direction of the roller relative to the movement direction of the first carrier element, the cleaning effect is increased since, with the aid of the roller, more ferromagnetic carrier particles for absorption of toner particles are directed to the first carrier element, said ferromagnetic carrier particles contacting the surface of the first carrier element and removing the toner particles adhering to it. The carrier particles that are located on the surface of the roller are rotated together with the roller, and thus transported in its circumferential direction via the rotation movement of the roller. A rough and/or structured roller surface aids this transport of the carrier particles.

In an advantageous embodiment of the invention, the axes of the poles of the magnet element are aligned radially relative to the rotation axis of the roller. It is thereby achieved that the magnetic field of the magnet element exerts a particularly large force on the ferromagnetic carrier particles in the area in which the pole of the magnet element facing the circumferential surface of the roller has a slight distance from the roller surface. Via this force, the carrier particles are aligned on the field lines of the magnet element and temporarily held at least in part in this area, such that a raised accumulation, what is known as a magnetic brush, is formed via the concentration of the carrier particles and their alignment. The distance between carrier element and roller is preferably smaller than or equal to the height of the magnetic brush on the roller. The distance between the roller and the first carrier element is preferably set in the range between 0.1 and 7 mm.

In a further embodiment of the invention, it is also possible that the quantity of the ferromagnetic carrier particles conveyed on the surface of the roller comprises a predetermined proportion of toner particles, whereby a particle mixture made up of carrier particles and toner particles is used for cleaning the roller. Particle mixtures made up of carrier particles and toner particles that have been previously used, for example, to ink a carrier element, can thus be used for cleaning. The toner application unit transfers toner particles of a two-component mixture made up of electrically charged and ferromagnetic carrier particles to the first carrier element. This two-component mixture is supplied to the roller of the cleaning unit after the transfer of at least one part of the toner particles to the first carrier element. The particle mixture supplied to the cleaning unit absorbs the toner particles remaining on the first carrier element. It is thereby achieved that the particle mixture must only be prepared once in the electrophotographic print or copy device. It is first used for toner application and subsequently for cleaning.

In another embodiment, the particle mixture is transferred from the toner application unit for cleaning of at least one magnet element with the aid of a magnetic field. Via the force of the magnetic field on the ferromagnetic carrier particles, these are transported from the toner application unit to the cleaning unit together with the toner particles located with the ferromagnetic carrier particles.

Alternatively, or in addition to this, the transfer of the particle mixture from the toner application unit to the cleaning unit can ensue with the aid of a guide element arranged between the toner application unit and the cleaning unit. Such a guide element can, for example, be a guide sheet or a conveyor device such as a transport band or a screw conveyor. It is thereby ensured that the particle mixture is continuously transferred from the toner application unit to the cleaning unit.

If permanent magnets are used as magnet elements, no energy supply is necessary for the magnet elements. Furthermore, permanent magnets are inexpensive and can be produced in nearly arbitrary forms. The side of the magnet elements facing the surface of the roller can thereby, for example, by implemented curved, such that the structure of the roller arrangement can be designed more compact. If a plurality of magnet elements whose poles are respectively aligned approximately radially relative to the rotation axis are arranged inside the roller, a plurality of magnetic brushes can thus be formed on the surface of the roller with the aid of these magnet elements. The transfer of toner and/or carrier particles can thus ensue simply, cost-effectively and without wear in the print or copy device.

In another advantageous embodiment of the invention, a first potential difference is generated between the toner application unit and the first carrier element, and/or a second potential difference is generated between the cleaning unit and the first carrier element. It is thereby achieved that the transfer of the toner particles from the toner application unit to the first carrier element or from the first carrier element to the cleaning unit ensues in a simple manner. With the aid of the potential differences, a simple transfer of the toner particles is cost-effectively possible between various elements with little design effort. The removal of the toner particles from the first carrier element is supported by this potential difference, whereby all toner particles are completely removed from the carrier element.

In an inventive method for operation of an electrophotographic print or copy device, the generation of qualitatively high-grade print images is simply and cost-effectively possible. The application of toner particles to carrier elements and the cleaning of the carrier elements with the aid of magnetic rollers ensues nearly without wear according to the inventive method.

DESCRIPTION OF THE DRAWINGS

For better understanding of the present invention, reference is made in the following to the preferred exemplary embodiments shown in the drawings that are described using specific terminology. However, it is to be noted that the scope of protection of the invention should not thereby be limited, since such changes and further modifications to the shown devices and/or to the method, as well as such further applications of the invention as they are shown therein, are viewed as typical present and future expert knowledge of a competent average man skilled in the art. The Figures show exemplary embodiments of the invention.

DETAILED DESCRIPTION OF THE PREFERRED EMBODIMENTS

Figure 1:
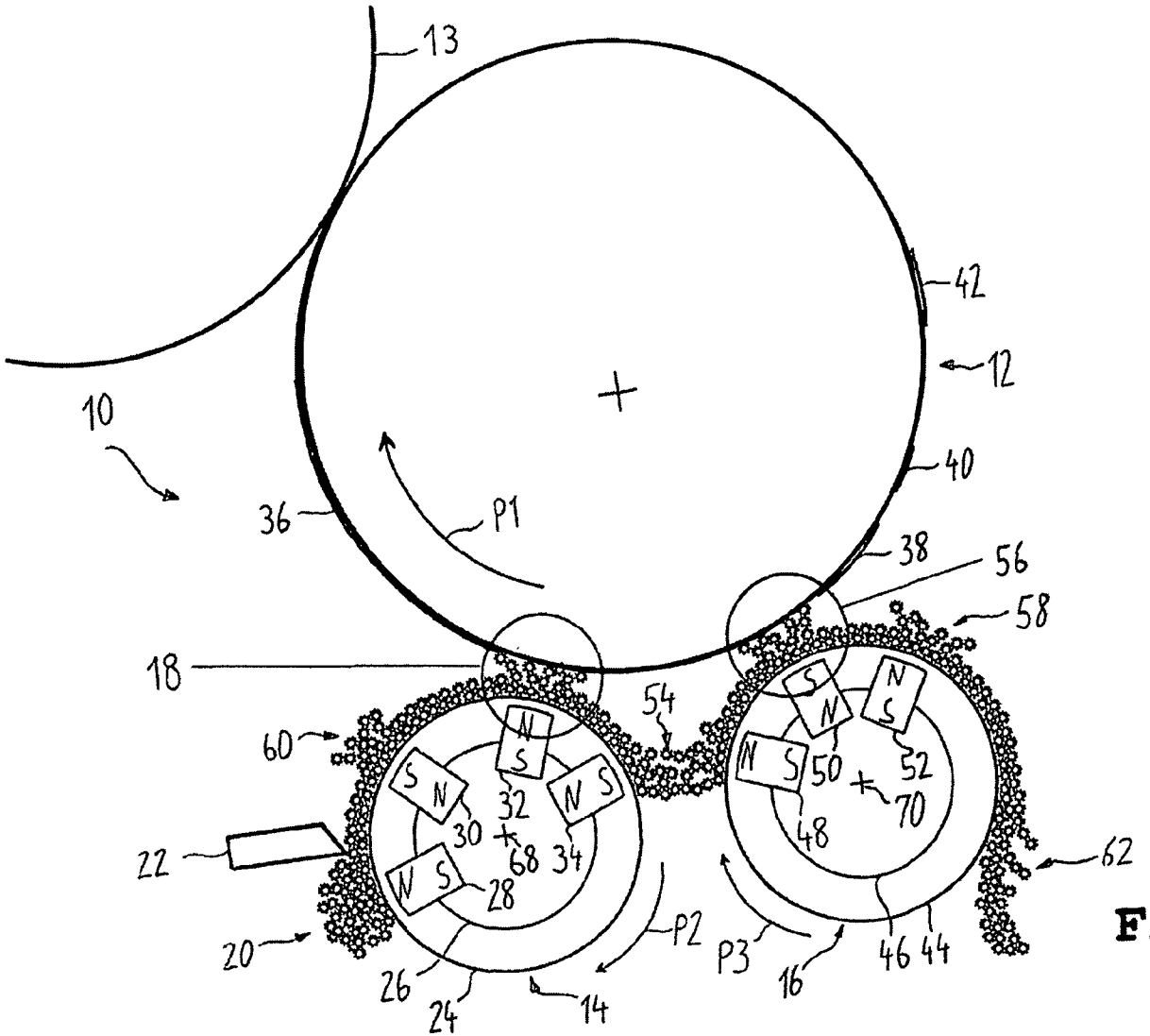
FIG. 1 is a pictorial side view of an arrangement to apply and remove toner to or from an applicator element surface, whereby a particle mixture made up of ferromagnetic carrier particles and electrically charged toner particles serves for application and for removal.

An arrangement 10 for toner application on an applicator roller 12 with the aid of a first magnetic roller arrangement 14 is shown in FIG. 1, whereby a particle mixture made up of electrically charged toner particle and ferromagnetic carrier particles, a "two-component mixture", is used to apply the toner on the applicator roller 12. Such an applicator roller 12 serves to transport toner particles in a printer or copier. In the following, the toner particles are also generally designated as toner. Applicator rollers 12 are in particular used to develop a latent charge image on a photoconductor element 13 with toner, whereby the surface of the applicator roller 12 is provided with a uniform toner layer 36. The uniform toner layer 36 is directed to the latent charge image of the photoconductor element 13, whereby the toner layer 36 is transferred from the applicator roller 12 to the photoconductor element 13 in the areas of the latent charge image to be inked.

To transfer toner particles to the surface of the applicator roller 12, a "magnetic brush" 18 is formed from the two-component mixture between the first magnetic roller arrangement 14 and the applicator roller 12. Located on a stator 26 inside a rotatable, hollow roller 24 of the arrangement 14 are oblong magnet elements 28, 30, 32, 34 whose poles are alternately directed outwards (viewed in the circumferential direction). The ferromagnetic carrier particles are arranged and aligned at each magnet element 28, 30, 32, 34 by the force effect of the magnetic field along the magnetic field lines, whereby an accumulation (separate from the roller surface 24) of carrier particles and the toner particles adhering to them is created pointing outwards on the surface of the roller 24 in the area of the poles of the magnet elements 28, 30, 32, 34. Such a separate accumulation of carrier particles is designated as a magnetic brush due to the brush-like shape.

A prepared two-component mixture with a predetermined weight proportion of toner particles is supplied to the first magnetic roller arrangement 14, whereby the toner particles are triboelectrically charged. The weight proportion of the toner is typically in the range of 2% to 8%. The feed of the two-component mixture ensues, for example, via a bucket wheel arrangement. A dosing scraper 22 arranged at a predetermined distance from the first magnetic roller arrangement 14 generates a uniform layer of the two-component mixture 20 on the outer surface of the roller 24.

The first magnetic roller arrangement 14 comprises, as noted, the one rotating hollow roller 24 inside which a magnetic roller stator 26 is arranged that comprises the magnet elements 28, 30, 32, 34. The longitudinal axes of the magnet elements 28, 30, 32, 34 are aligned in a radial direction, whereby north pole N and south pole S of neighboring magnet elements 28, 30, 32, 34 respectively follow one another, viewed in the circumferential direction. The magnet elements 28, 30, 32, 34 may be rod-shaped permanent magnets and extend over the entire roller width. In this embodiment, the separation between each of the permanent magnets 28, 30, 32, 34 and the inner surface of the roller 24 is set in the range of 0.2 to 1 mm, whereby a separation in the range of 1.2 mm to 3 mm results between each of the permanent magnets 28, 30, 32, 34 and the outer circumferential surface of the roller 24.

A constant toner supply in the two-component mixture 20 is ideally present in the area of the magnetic brush 18. The toner particles on the carrier particles of the magnetic brush 18 apply to the surface of the applicator roller 12 as a uniform toner layer 36. An electrical field generated by a potential difference between the surface of the applicator roller 12 and the roller 24 exerts a force on the electrically charged toner particles, via which the toner particles are loosened from the carrier particles and applied to the applicator roller 12. These electrostatic events are explained in detail later.

The applicator roller 12 is directed to a photoconductor (not shown). Corresponding to the latent charge image of the photoconductor, areas of the toner layer 36 are transferred to this over an air gap or in direct contact between the applicator roller 12 and the photoconductor. The areas 38, 40, 42 of the toner layer 36 not transferred to the photoconductor form the image negative relative to the latent charge image and must be removed from the applicator roller 12. The cleaning ensues via a second magnetic roller arrangement 16.

Just like the first magnetic roller arrangement 14, this second magnetic roller arrangement 16 has a rotating hollow roller 44 and a magnetic roller stator 46 that comprises e.g., rod-shaped magnet elements 48, 50, 52 that are implemented as permanent magnets and aligned radially. The rotation direction of the applicator roller 12 is indicated with the arrow P1, the rotation direction of the roller 24 with the arrow P2, and the rotation direction of the roller 44 with the arrow P3. The two-component mixture is transferred in the area 54 from the surface of the roller 24 to the surface of the roller 44 with the aid of the magnetic field of the magnet elements 34 and 48. Given a rotation of the roller 24 in the resulting magnetic field, the ferromagnetic carrier particles, with the toner particles electrostatically adhering to them, are transported between the south pole S of the permanent magnet 34 and the north pole N of the permanent magnet 48.

The weight proportion of the toner particles in the two-component mixture in the area 54 is reduced relative to the prepared two-component mixture supplied in the area 20, as a result of the toner transfer to the applicator roller 12. This two-component mixture with reduced toner proportion is transported to the surface of the roller 44 at the area 56.

The magnetic field of the magnet element 50 effective in area 56 generates a magnetic brush. In the area 56, the separation between roller 44 and applicator roller 12 is relatively small. The magnetic brush in the area 56 comprises the two-component mixture with reduced toner portion. Due to the potential difference between the surfaces of the roller 44 and the applicator roller 12, the toner residues 38, 40, 42 are loosened from the surface of the applicator roller 12 electrostatically and via abrasion of the magnetic brush on the surface of the applicator roller 12 and transported in the direction of the roller 44. The two-component mixture of the magnetic brush 56 contacts the surface of the applicator roller 12 and additionally abrades the toner particles from the surface of the applicator roller 12. Further magnetic brushes 58, 60 are created on the magnet element 52 of the second magnetic roller arrangement 16 as well as on the magnet element 30 of the first magnetic roller arrangement 14. After the cleaning of the surface of the applicator roller 12 with the aid of the magnetic brush in the area 56, the two-component mixture is transported further to the surface of the roller 44 and loosened in the area 62 by the roller 44 of the second magnetic roller arrangement 16, and afterwards is collected in a catch device (not shown) and supplied again to the electrophotographic process of the printer or copier in which the arrangement 10 is comprised. In other embodiments, the particle mixture falls directly into a "mixture sump", in which the two-component mixture is prepared again.

Figure 2:
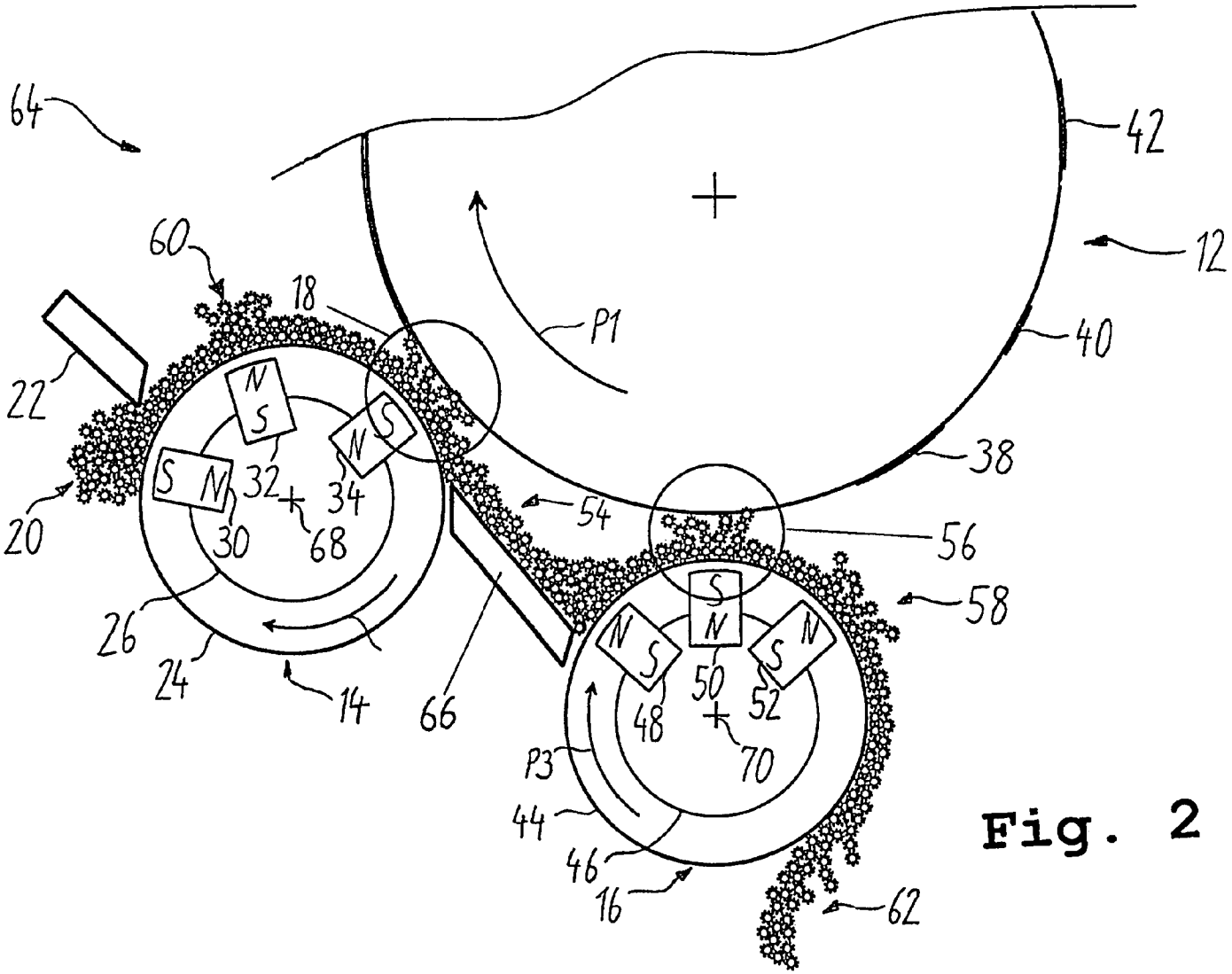
FIG. 2 is a pictorial side view of a further arrangement to apply and remove toner, similar to the arrangement shown in FIG. 1.

An arrangement 64 similar to the arrangement 10 from FIG. 1 is shown in FIG. 2. Identical elements have the same reference characters. In contrast to the arrangement 10 from FIG. 1, a guide element 66 is used to transfer the two-component mixture in the area 54. Such a guide element 66 is, for example, fashioned as a guide sheet. The rotation axis 68 of the first magnetic roller arrangement 14 is arranged (viewed in the vertical direction) above the rotation axis 70 of the second magnetic roller arrangement 16. The guide element 66 is arranged inclined, such that the two-component mixture can glide or slide from the first magnetic roller arrangement 14 to the second magnetic roller arrangement 16 on a suitable plane. Given larger roller separations, or given a horizontal arrangement of the rotation axes 68, 70, instead of a guide element 66, it can be advantageous to also provide a conveyer device, for example a transport band or a bucket wheel between the first magnetic roller arrangement 14 and the second magnetic roller arrangement 16.

Figure 3:
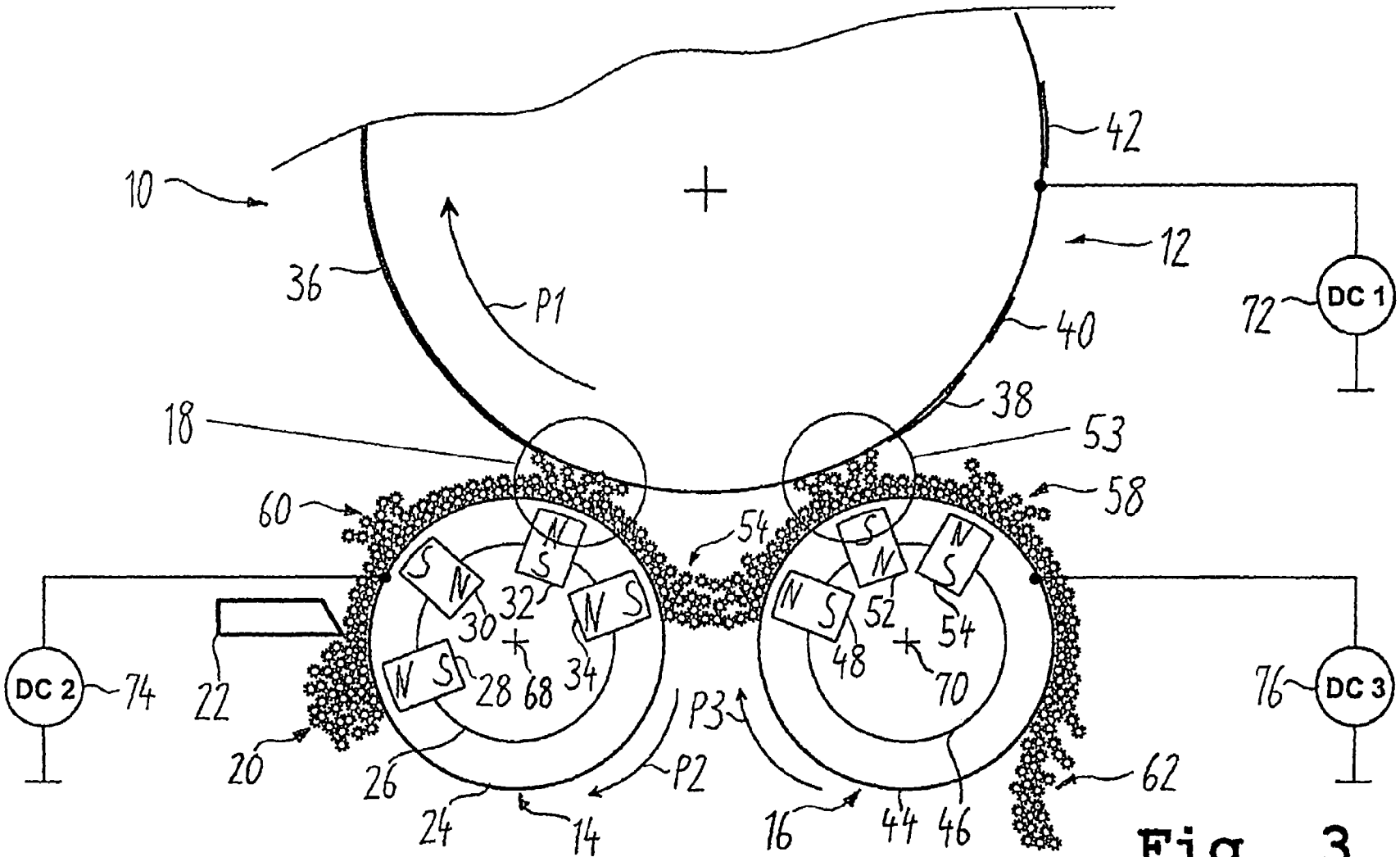
FIG. 3 is a pictorial side view of the arrangement from FIG. 1, whereby electrical potentials of the roller surfaces are shown.

In FIG. 3, the arrangement 10 shown in FIG. 1 is shown with the electrical potentials of the roller surfaces set in the operating state. Relative to a ground potential as a reference potential, the surface of the applicator roller 12 has a potential difference DC1; relative to the ground potential, the outer surface of the roller 24 has a potential difference DC2; and relative to the ground potential, the outer surface of the roller 44 has a potential difference DC3. In the arrangement shown in FIG. 3, a negative toner system is used. Taking into account the polarity sign in a negative toner system, the potential difference DC1 is to be set smaller than the potential difference DC2, and the potential difference DC3 is to be set greater than the potential difference DC1.

If, in another embodiment, a positive toner system is used in the arrangement shown in FIG. 3, under consideration of the polarity sign the potential difference DC1 is to be set smaller than the potential difference DC2, and the potential difference DC3 is to be set smaller than the potential difference DC1.

In the arrangement according to FIG. 3 with a negative toner system, the potential differences relative to the reference potential are set to DC1=500 volts, DC2=100 volts, and DC3=700 volts. The potential differences are generated by direct voltage sources 72, 74, 76. However, in other embodiments it is also possible to apply one of these potentials DC1, DC2, DC3 to reference potential, and to correspondingly select the voltage of the other two direct voltage sources.

Negative voltages are also possible with regard to the ground potential. In other exemplary embodiments, other set potentials DC1, DC2, DC3 of the surfaces of the rollers 12, 24, 44 set with regard to the reference potential are also possible. The potentials to be set primarily depend on the composition of the toner material, on the distances between the rollers 12, 24, 44, and on the roller materials. The electrostatic events that are achieved via the set potentials DC1, DC2, DC3 are primarily dependent on the potential difference (DC1-DC2) (arising from the potentials DC1, DC2, DC3) between the surfaces of the applicator roller 12 and the magnetic roller arrangement 14, and on the potential difference (DC1-DC3) between the surfaces of the applicator roller 12 and the magnetic roller arrangement 16, under consideration of the polarity sign.

With an arrangement shown in FIGS. 1 through 3, it is possible to simply and cost-effectively produce a nearly wear-free system to apply and clean toner on or from rollers 12. The roller 12 to be cleaned, for example, an applicator roller or a photoconductor roller, is not mechanically stressed or is only slightly mechanically stressed in the cleaning process. This is primarily achieved by the direct absorption of the toner 38, 40, 42 in the two-component mixture. The mechanical stress of the toner is also slight or nonexistent via the direct absorption of the toner particles into the two-component mixture. Only a very slight heat development also ensues in the application and/or cleaning. In a print or copy device with an arrangement according to FIGS. 1 through 3, particle mixtures made up of toner particles and carrier particles with different physical properties (meaning with different toner parameters) can be used, whereby a large working range with regard to thee parameters of the particle mixture is possible. Also, no special additives are necessary for the cleaning device, as, for example, are necessary in cleaning systems with blades, in which additional waxes must be added to the toner.

In an arrangement shown in FIGS. 1 through 3, not only does the inking of the applicator roller surface ensue with the aid of a magnetic roller arrangement 14, but also its cleaning. The electrical potentials DC1, DC2, DC3 explained in the description for FIG. 3 and the potential difference resulting from this between the surfaces of the applicator roller 12 and the roller 44 results in an electrical field between the rollers 12, 44 whose force acts on the toner particles in the direction of the roller 44 or in the direction of the two-component mixture on the roller surface. The toner can thereby be removed from the applicator roller 12 in direct contact with the two-component mixture, or be transferred via an air gap between applicator roller 12 and magnetic roller arrangement 16 to the two-component mixture on the surface of the magnetic roller arrangement 16.

Figure 4:
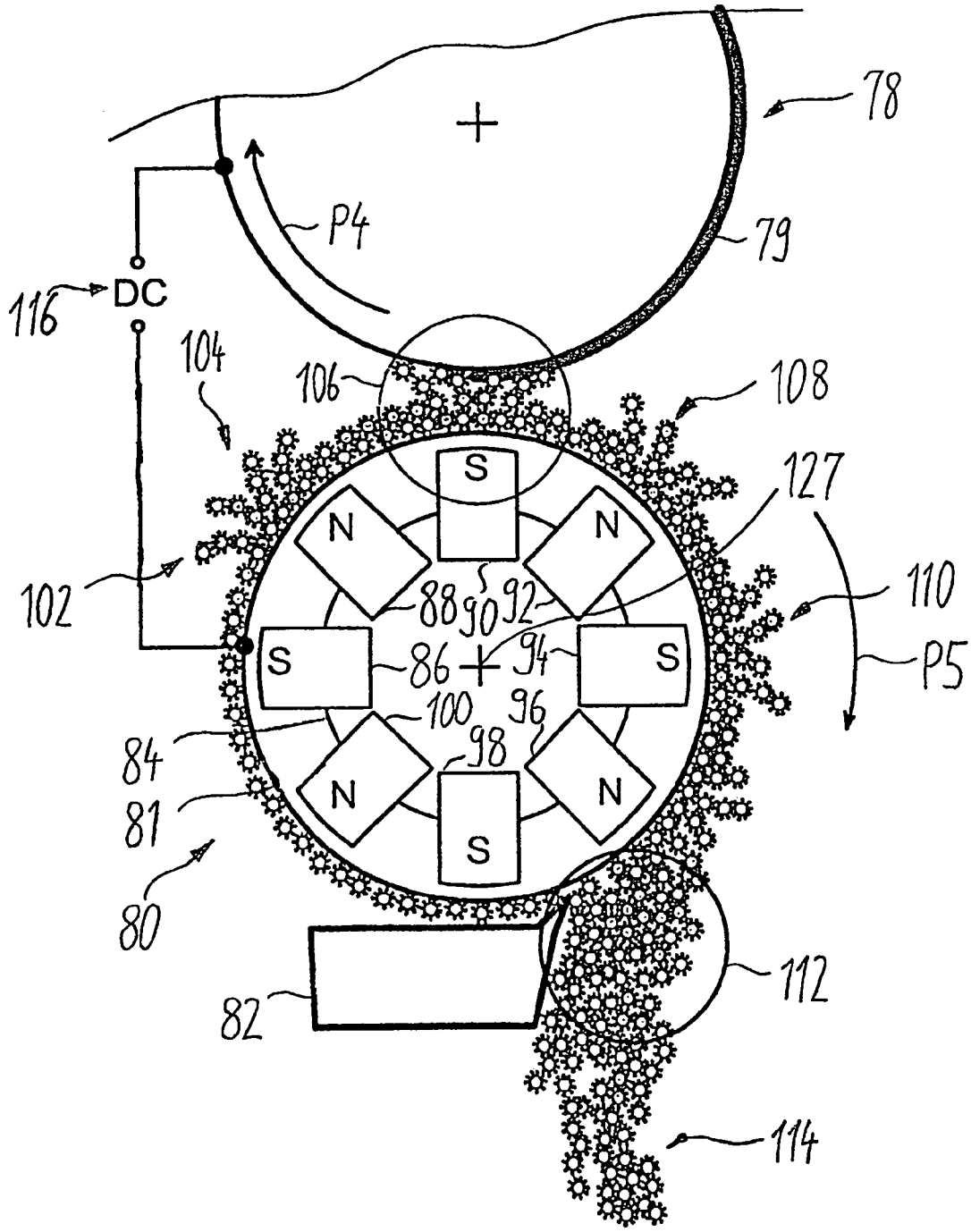
FIG. 4 is a pictorial side view of an arrangement to clean an applicator element with the aid of a magnetic roller arrangement, whereby a scraper-magnet element device serves for cleaning of the magnetic roller arrangement.

In FIG. 4, an arrangement for cleaning an applicator roller 17 with the aid of a magnetic roller system 80 with a rotating hollow roller 81 is shown. This arrangement also comprises a cleaning device with magnet elements 96, 98 and a scraper 82 to clean the outer surface of the roller 81. Toner particles 79 to be removed are located on the surface of an applicator roller 78. The magnetic roller system 80 is arranged at a predetermined distance from the applicator roller 78 and has a magnetic roller stator 84 on which the permanent magnets 86 through 100 are arranged at equal separation from one another on a circuit around the rotation axis 127 of the magnetic roller system 80. The axis of the poles N, S of each individual permanent magnet 86 through 100 is aligned radial to the rotation axis 127, meaning the north pole or the south pole of each permanent magnet 86 through 100 is facing to the surface of the roller 81 of the magnetic roller system 80.

In the area 102, ferromagnetic carrier particles are supplied to the roller 81 as pure carrier particles or with the aid of a particle mixture made up of carrier particles and toner particles. This feed of carrier particles can, for example, ensue from a second roller system (not shown) for toner application; this has already been explained in FIGS. 1 and 2. However, in other exemplary embodiments these carrier particles can also be supplied to the magnetic roller system 80 from a reservoir.

The magnetic fields of the stationary permanent magnets 88, 90, 92, 94 form magnetic brushes 104, 106, 108, 110, 112 (from carrier particles) on the surface of the roller 81. The permanent magnet 90 is arranged in the area with least separation between applicator roller 78 and magnetic roller system 80. The magnetic brush 106 formed on the surface of the roller 81 abrades on the surface of the applicator roller 78, whereby toner particles 79 to be removed are rubbed off. The toner particles 79 attach to the carrier particles of the magnetic brush 106. The detachment of the toner particles 79 from the surface of the applicator roller 78 and the attachment of these toner particles to the carrier particles of the magnetic brush 106 is furthermore influenced by the force of an electrical field on the carrier particles 79, and by the particles abrading on the surface of the applicator roller 12. This electrical field is generated due to the potential difference DC between the surfaces of the applicator roller 78 and the roller 81, which is adjusted with the aid of a direct voltage source 116.

The rotation direction of the applicator roller 78 and the roller 81 are the same, as indicated by the arrows P4 and P5. It is thereby achieved that a large quantity of ferromagnetic carrier particles on the applicator roller 112 to be cleaned is directed to the region of the magnetic brush 106 on the applicator roller 78, whereby a mechanical brush effect, via which carrier particles are abraded from the surface, is exerted on the surface of the applicator roller 78 with the aid of the magnetic brush 106. The circumferential speed of the applicator roller 78 and of the magnetic roller system 80 are of approximately the same magnitude.

In other exemplary embodiments, the circumferential speed of the magnetic roller system 80 is smaller or larger than the circumferential speed of the applicator roller 78. In further exemplary embodiments, the rotation directions of the applicator roller 78 and the magnetic roller system 80 are opposite to one another, such that, for example, the rotation direction of the magnetic roller system 80 is directed counter to the rotation direction according to the arrow P5. It is thereby achieved that the mechanical stress of the carrier particles and toner particles is further reduced in the area of the magnetic brush 106. In an arrangement with rotation direction set counter to the arrow P5, the elements of the arrangement (meaning the area 102 as well as the scraper 82) are to be arranged mirrored on the straight lines through both rotation axes of the applicator roller 78 and the magnetic roller system 80. The further magnetic brushes 104, 108, 110, 112 then in turn form on the permanent magnets 92, 88, 86, 100 arranged mirrored on these straight lines.

The toner particles removed from the applicator roller 78 in the area of the magnetic brush 106 are acquired by the carrier particles of this magnetic brush and transported away in the rotation direction of the magnetic roller system 80. The permanent magnet 96 is arranged just before the scraper 82 in the rotation direction P5 of the magnetic roller system 80. The blade of the scraper 82 is arranged at a predetermined distance from the surface of the roller 81, whereby a part of the particle mixture made up of carrier particles and toner particles is stripped from the surface of the magnetic roller system 80 given a rotation motion of the magnetic roller system 80.

Due to the force acting on the ferromagnetic carrier particles of the particle mixture via the magnetic field of the permanent magnet 96, not just one magnetic brush is held directly on the north pole N of the permanent magnet 96 on the surface of the roller 81, but rather stripped carrier particles are additionally held in the area 112 with the aid of the scraper 82, such that a cluster made up of carrier particles and toner particles forms in the area in front of the scraper 82. This cluster is also designated as a standing particle mixture. The force effect on the carrier particles becomes less with increasing distance from the permanent magnet 96, whereby parts of the two-component mixture in the lower area 114 of the cluster fall into a catch reservoir (not shown) for reprocessing of the particle mixture.

Given a rotation motion of the hollow roller 81, the carrier particles and toner particles are mixed and swirled in the are 112 such that, given a rotation motion of the roller 81, the particle mixture abrades on its surface, whereby toner particles that adhere directly to the surface of the roller 81 are abraded from this. The movement events within the cluster, meaning in the area 112, are explained in detail further below in connection with FIG. 7. In other embodiments, the particle mixture falls directly into a "mixture sump", in which the two-component mixture is prepared.

Figure 5:
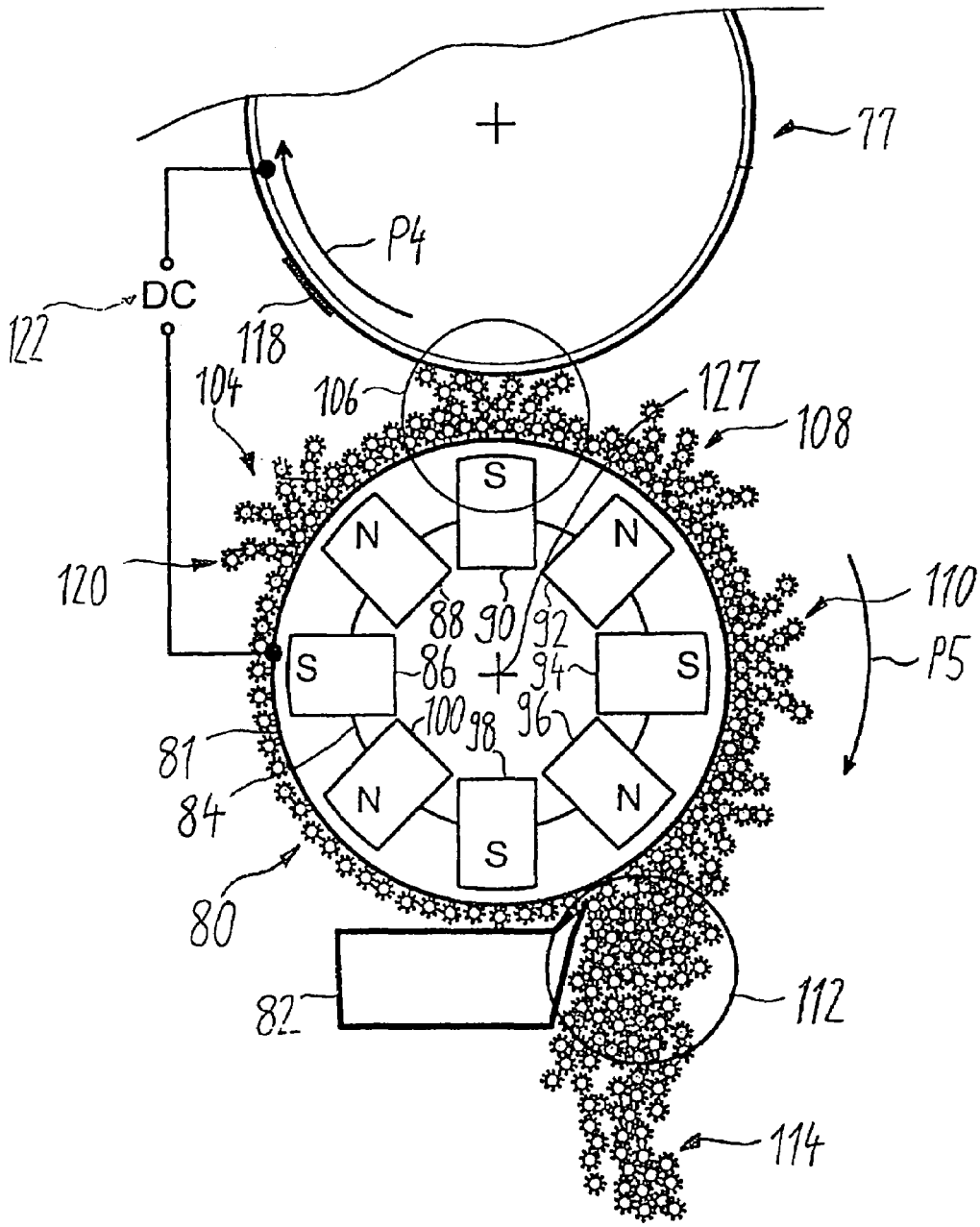
FIG. 5 is a pictorial side view of an arrangement to develop a latent charge image on a photoconductor drum with the aid of a magnetic roller arrangement, as well as a scraper-magnet element device to clean the magnetic roller arrangement.

FIG. 5 shows primarily the arrangement from FIG. 4 that here, however, serves for the development of a latent charge image that is located on the surface of a photoconductor drum 77. A toner layer 118 is applied or attached to the surface of the photoconductor drum in the areas to be inked. The assembly of the arrangement shown in FIG. 5 is similar to the arrangement shown in FIG. 4 to clean the applicator roller 78. Identical elements have the same reference characters.

In area 120, a two-component mixture (meaning a particle mixture made up of carrier particles and toner particles) in which the toner particles have a weight proportion in the range of 2% to 8% of the particle mixture is supplied to the magnetic roller system. As already specified in connection with FIG. 4, a magnetic brush is formed in the area 106 by the permanent magnet 90. This magnetic brush contacts the surface of the photoconductor drum 77. As already noted, a latent charge image is present on this surface. Due to the charge image in the areas to be inked, the surface of the photoconductor drum 77 has a potential difference DC relative to the roller 81 that is generated by a direct voltage source 122.

Given a negative toner system, meaning given negatively charged toner particles, the potential of the areas of the photoconductor drum 77 to be inked is to be set positive relative to the potential of the surface of the roller 81. In contrast, given a positive toner system the potential of the areas of the photoconductor drum 77 to be inked is to be set negative relative to the potential of the surface of the roller 81.

The potential difference between the areas of the photoconductor drum 77 to be inked and the roller 81 effects the electrostatic application of toner particles 118 on the surface of the photoconductor drum 77 in the areas to be inked. In the areas of the photoconductor drum 77 that are not to be inked (the "background area"), a potential difference opposite relative to that of the areas to be inked is to be set, whereby a force effect is effected on the toner particles in the direction of the roller 81, and thus no toner particles are deposited in the background area. The force effects on the toner particles as a result of the potential differences have already been explained in the figure specification with regard to FIG. 3. The scraper-magnet element arrangement shown in FIG. 5 for cleaning the magnetic roller surface has already been specified in connection with FIG. 4.

Figure 6:
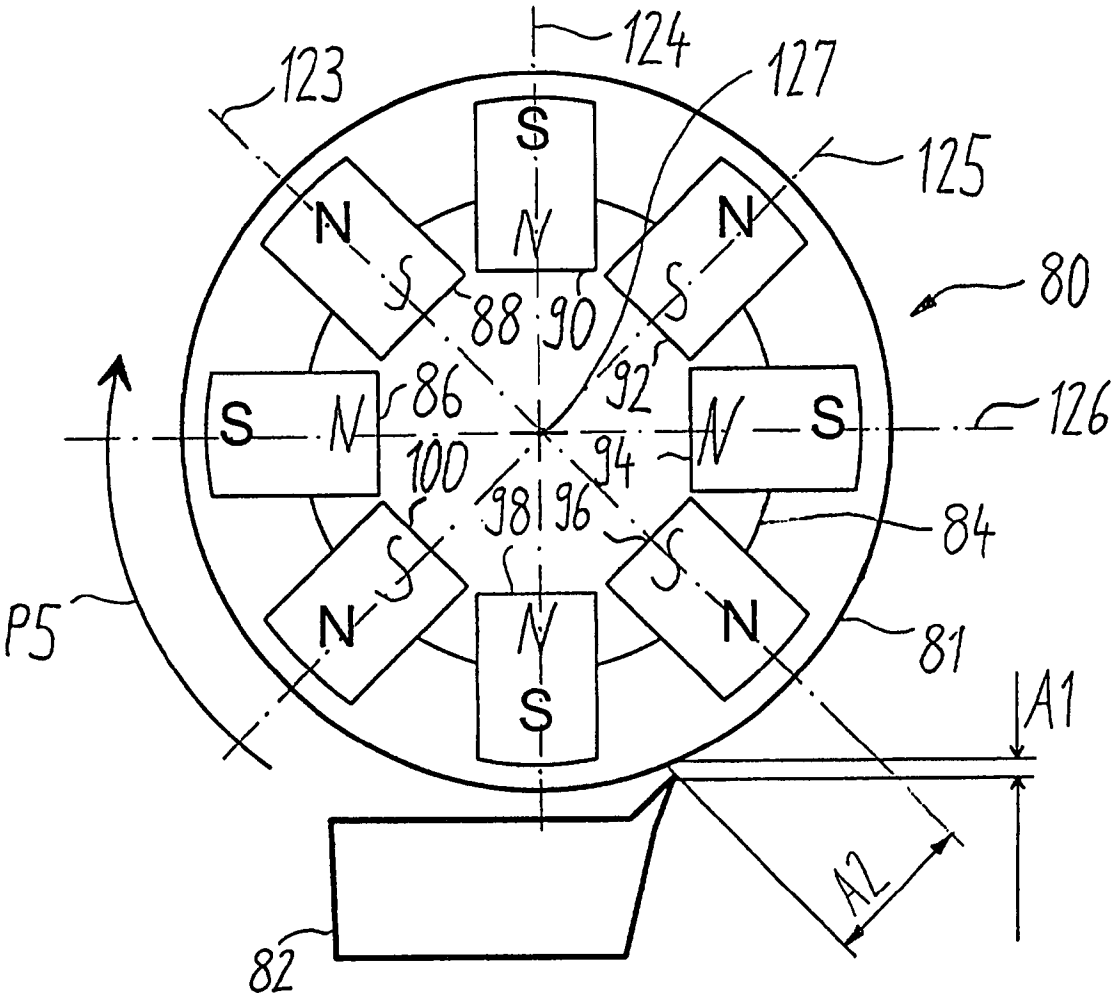
FIG. 6 is a pictorial side view of an exemplary embodiment for the configuration of the magnet stator and the scraper, in which the surface of the magnetic roller arrangement is cleaned of toner particles.

In FIG. 6, the magnetic roller system 80 that is used in the arrangements shown in FIGS. 4 and 5 is shown enlarged. The distance between the blade of the scraper 82 and the outer surface of the roller 81 is designated with A1. This distance A1 is set in the range of 0.05 to 6 mm, dependent on the physical properties of the particle mixture. In the shown embodiment, the distance A1 is set in the range of 0.1 mm to 4 mm. The longitudinal axis 123 of the permanent magnet 96 arranged on the magnetic roller stator 84 is arranged at a predetermined distance A2 (viewed in the rotation direction of the roller 81) in front of the blade of the scraper 82. This separation A1 is set in the range of 0.01 to 10 mm, dependent on the physical properties of particle mixture and on the circumferential speed. A particularly effective cleaning effect could be achieved given a separation in the range of 4 mm to 6 mm.

The longitudinal axes 123, 124, 125, 126 of the permanent magnets 86 through 100, shown via dash-dot lines, go through the rotation axis 127, meaning the center points of the north pole N and the south pole S of the permanent magnets 86 through 100 line approximately on the straight lines 123 through 126. The straight lines 123 through 126 have an angular separation of 45° from one another, meaning the permanent magnets 86 through 100 are arranged at the same angular separation from one another on an orbit around the rotation axis 127. A separation in the range of 0.2 mm to 1.5 mm is respectively set between the permanent magnets 86 through 100 and the inner surface of the roller 81. The distance between the permanent magnets 86 through 100 and the outer surface of the roller 81 results corresponding to the material strength of the roller 81, and is in the range of 2.3 mm to 3.5 mm.

What has proven particularly advantageous is a separation in the range of 0.2 mm to 1 mm between the side of the permanent magnets 86 through 100 facing the roller 81 and the inner surface of the roller 81, and in the range of 2 mm to 3 mm between the side of the permanent magnets 86 through 100 facing the roller 81 and the outer surface of the roller 81. Given these separations, not only are suitable magnetic brushes formed, but rather also a cluster-like accumulation of the particle mixture in the area 112, as is shown in FIGS. 4 and 5. However, the distance between the permanent magnets 86 through 100 and the surface of the roller 81 is dependent on the field strength of the magnet elements 86 through 100 used, on the print speed of the print or copy device, most of all on the circumferential speed of the outer roller surface, on the physical properties of the toner used, and particularly on the physical properties of the carrier particles.

For example, ferrite and iron can be used as carrier particle material, whereby the magnetic saturation of the carrier particle material is particularly significant. Furthermore, the separation is dependent on the overall arrangement of the print or copy device. Thus distances that are outside of the cited ranges can also be set when the circumferential speed increases, other toner material is used, other carrier particle material(s) is/are used, and/or a changed overall arrangement of the print or copy device is used.

Figure 7:
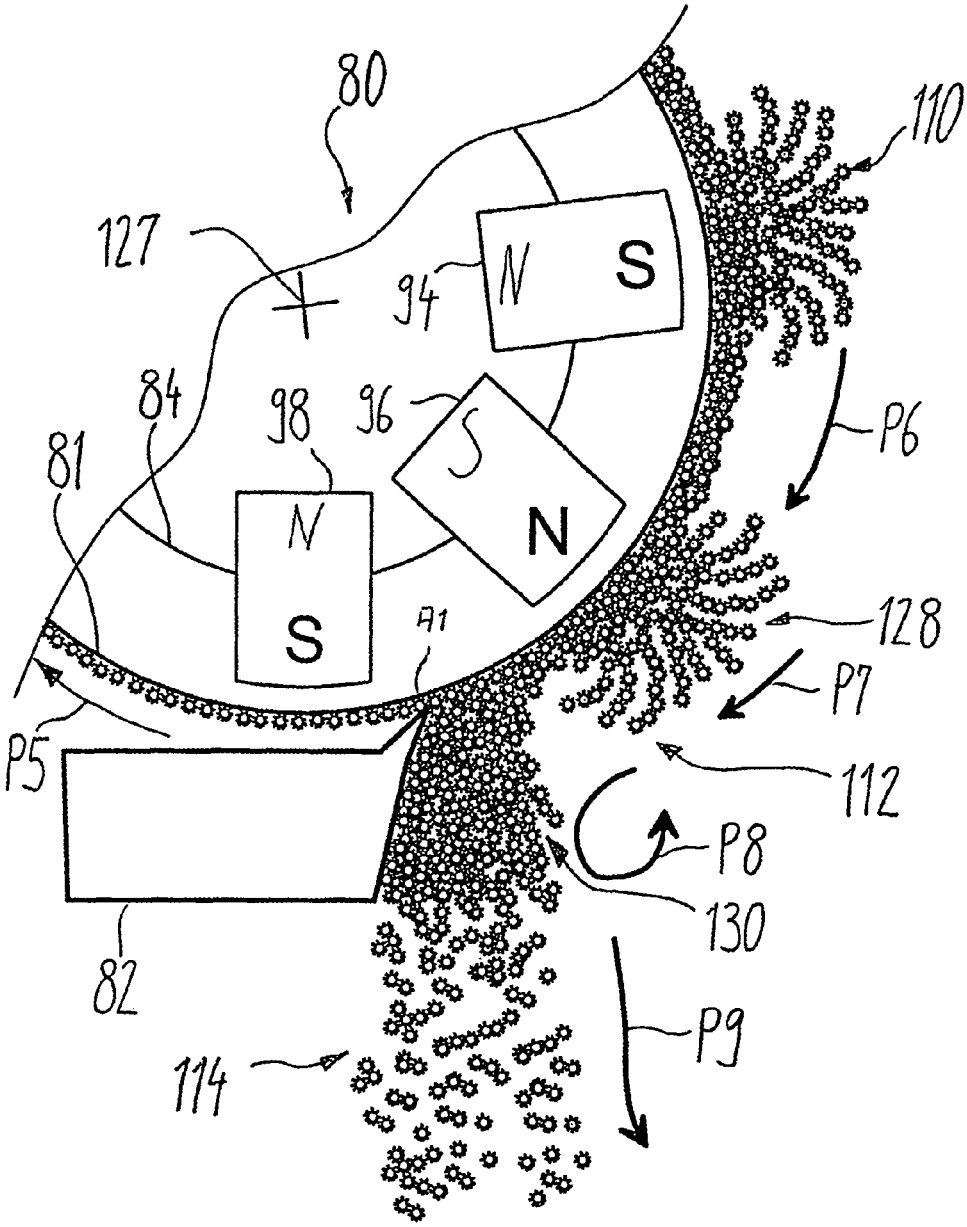
FIG. 7 is a pictorial side view illustrating the movements within the particle mixture in the area of the magnetic roller in the arrangement shown in FIG. 5.

A section of the magnetic roller system 80 is shown in FIG. 7 together with the scraper 82, whereby the movements within the particle mixture (that result given a rotation motion of the roller 81 in the direction of the arrow P5) are shown with the aid of the arrows P6, P7, P8, P9. The arrangement of the particle mixture in the area 112 is also shown in more detail relative to the representations of FIGS. 4 and 5. A magnetic brush 128 is formed on the north pole N of the permanent magnet 96 via its magnetic field. An accumulation of the particle mixture made up of toner particles and carrier particles (that are held in this area by the magnetic field of the permanent magnet 96) forms cluster-like in front of the blade of the scraper 82.

As indicated by arrow P6, the particle mixture is transported on the roller surface between the magnetic brushes in the areas 110 and 128 at approximately the circumferential speed of the roller 81. The particle mixture is conveyed from the magnetic brush in area 128 to the cluster-like accumulation of the particle mixture in front of the scraper 82. As already explained, a part of the particle mixture is held cluster-like in front of the scraper 82 (viewed in the rotation direction of the roller 81) by the field forces of the permanent magnets 96, 98 in the area 130. Via the rotation motion of the hollow roller 81 and via the feed of further particle mixture connected therewith, a rotating, roller-shaped movement (that is indicated with the aid of the arrow P8) forms within the particle mixture in front of the scraper 82.

The particle mixture is circulated in the area 130 in front of the scraper 82, whereby it abrades on the surface of the roller 81. Primarily the carrier particles abrade, whereby toner particles that directly adhere to the roller surface are abraded from the roller surface. The formation of an electrically insulating crust-like layer and electrically insulating areas made up of toner particles on the magnetic roller surface is effectively prevented by the abrasion of the toner particles on this surface. Electrostatic events such as the transfer of toner particles from or to the roller 81 are thus not impaired. Dependent on the field forces of the particle mixtures 96, 98, a more or less large cluster-like accumulation 130 forms in front of the scraper 82. This accumulation 130 is also designated as a standing particle mixture.

In the lower area of the cluster-like accumulation 130, the forces of the magnetic fields of the permanent magnets 96, 98 acting on the carrier particles are less than at the roller surface, such that parts 114 of the particle mixture fall down in the arrow direction of the arrow P9 into a catch reservoir (not shown). The distance A2 (see FIG. 6) to be set between the permanent magnet 96 and the blade of the scraper 82 is dependent on the circumferential speed of the roller 81, on the surface roughness of the roller 81, on the toner used, on the carrier particle material used, on the speed of the print or copy device, and on the overall arrangement of the print or copy device.

The surface of the roller 81 is electrically conductive. It can, for example, comprise aluminum, copper, nickel, conductive plastic or a combination of these materials, for example an alloy. In other exemplary embodiments, the poles N, S of the magnet elements 86 through 100 can vary in shape, design and field strength. The shape of the magnet elements 86 through 100 can thus also not be rod-shaped, such that only the pole N, S facing the roller surface acts in the direction of the normal. The magnet elements 86 through 100 can also have different field strengths. A resulting magnetic field that results via an addition of the field vectors of the magnetic fields results between the poles N, S of permanent magnets 86 through 100 with opposite alignment arranged next to one another, for example between the south pole S of the permanent magnet 94 and the north pole N of the permanent magnet 96. The ferromagnetic carrier particles of the two-component mixture align on the field lines of the resulting magnetic field. The transport of the continuously provided two-component mixture to the surface of the roller 81 ensues via its rotation.

The roller 81 has a roughness in the range of 1 μm to 5000 μm. It has proven to be particularly advantageous to set the roughness in the range of 10 μm to 3000 μm. Given this roughness, a secure transport of the particle mixture is ensured and the detachment of toner particles from the roller surface is not hindered. The separation A1 between the surfaces of the scraper 82 and the roller 81 is preferably less than the thickness of the layer of the particle mixture in front of the scraper 82. The thickness of the layer of the particle mixture remaining after the scraper 82 is limited by the distance A1 between roller surface and scraper blade, and can be set by changing the separation A1.

The part of the particle mixture blocked by the scraper 82 forms the standing particle mixture relative to the roller 81 on its surface. The force with which the ferromagnetic particle mixture made up of toner particles and carrier particles adheres to the surface of the roller 81 is dependent on the ferromagnetic properties of the carrier particle material, on the magnetic field strength of the magnet elements 86 through 100, primarily on the field strength of the permanent magnets 96, 98, and on the distance between the surface of the roller 81 and the respective permanent magnets 86 through 100.

The standing particle mixture in the area 112 or 130 in front of the scraper 82 abrades on the outer surface of the roller 81 given a rotation motion of the roller 81. Via this abrasion, the toner adhering to the surface of the roller 81 is rubbed off and acquired again by the particle mixture, whereby the abraded toner particles electrostatically adhere to the carrier particles. It is thereby achieved that a permanent toner particle layer on the surface of the roller 81 is prevented, and the electrostatic process in the printer or copier is not impaired.

The portions of the particle mixture that pass the scraper 82 remain on the surface of the roller 81. In other exemplary embodiments, these can also be separated from the roller surface via corresponding design layout of the magnet stator 136 (see FIG. 8) and be supplied to a catch device, for example, the mixture sump of the printer or copier, or be transferred to an adjacent magnetic roller system.

In order to reduce the mechanical energy necessary to implement the cleaning process, it is possible in other embodiments to provide the outer surface of the roller 81 with a coating that has a very low surface energy. Such a coating can, for example, be produced with the aid of Teflon. The entire roller 81 can also be produced from such a material. However, in order to not negatively influence the electrostatic process, such a coating should have no electrically-insulating properties, but rather should be correspondingly conductive for charge transport from and to the roller 81.

Embodiments are also possible in which the highly-insulating material with low surface energy is only applied in the recesses of a rough surface of the roller 81. The remaining conductive areas ensure the necessary charge flux. The arrangement for cleaning requires no additional auxiliary energy. Furthermore, the abrasion events additionally triboelectrically charge the toner in the cleaning.

The arrangement for cleaning of the surface of magnetic roller systems comprise no wearing parts. Via the simple design, a compact implementation of the cleaning device and the entire print or copy device is also possible. It is also suitable to use various particle mixtures with different toner parameters. The magnetic roller system 80 can both remove toner particles from applicator roller 78 and from photoconductors and develop latent charge images on photoconductors and ink applicator rollers 78. In place of an applicator roller 78, in other exemplary embodiments, applicator bands or transfer bands can be used. In further exemplary embodiments, other magnet elements such as electromagnets are used in place of the permanent magnets. The arrangements shown in FIGS. 4 and 5 can, for example, also be used in an arrangement according to FIGS. 1 and 2.

Figure 8:
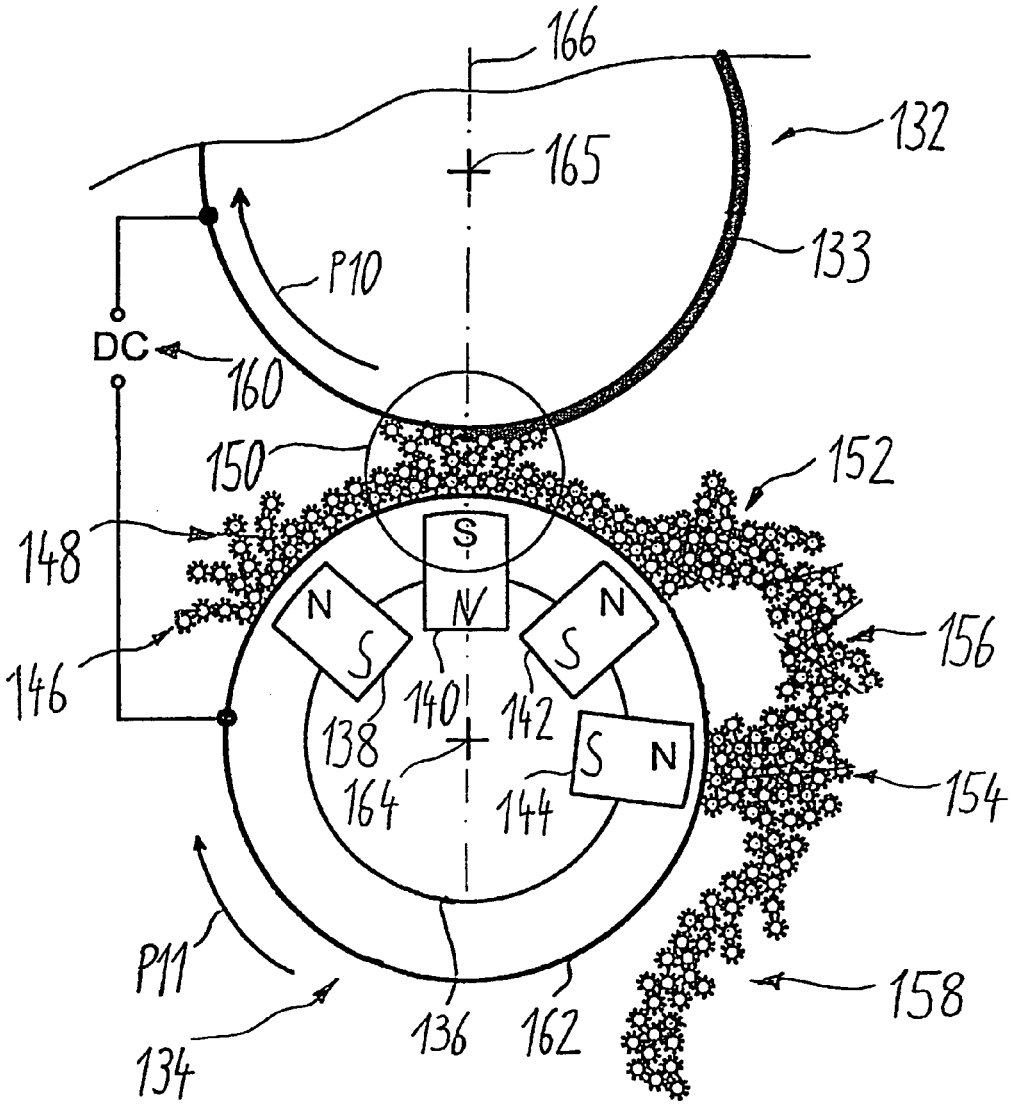
FIG. 8 is a pictorial side view of an arrangement to remove toner particles from a magnetic roller with the aid of a magnet arrangement made up of two magnet elements, whereby the magnetic roller serves for the removal of a homogenous toner layer on an applicator roller.

An arrangement for cleaning the surface of an applicator roller 132 is shown in FIG. 8. This arrangement serves to remove a toner layer 133 and toner residues from the surface of the applicator roller 132, and comprises a magnetic roller arrangement 134 with a magnetic roller stator 136 which has permanent magnets 138, 140, 142, 144, and with a rotating hollow roller 162 that is driven in the rotation direction P11 with an actuation unit (not shown).

The toner particles of the toner layer 133 electrostatically adhere to the surface of the applicator roller 132. A drive unit (not shown) drives the applicator roller 132 in the rotation direction of the arrow P10. A direct voltage source 160 generates a potential difference DC between the surfaces of the applicator roller 132 and the roller 162. The force of the electrical field generated by the potential difference DC on the toner particles of the toner layer 133 is directed towards the surface of the roller 162.

In the area 146, ferromagnetic carrier particles are supplied to the magnetic roller system 134 with the aid of a device (not shown). In other exemplary embodiments, in the area 146 a particle mixture made up of electrically charged toner particles and ferromagnetic carrier particles can be supplied to the magnetic roller system 134.

The alignment of the poles N, S of the magnet element 138 is, just like the alignment of the poles of the magnet elements 140, 142, 144, radial to the rotation axis 164, meaning that the north pole N or the south pole S of a magnet element 138, 140, 142, 144 is respectively facing the inner surface of the roller 162. The magnet element 140 is arranged in the area with the lowest separation between the applicator roller 132 and the roller 162. If the poles N, S are considered as points, the poles N, S of the magnet element 140 lie approximately on a straight line 166 (represented as a dash-dot line) that intersects the rotation axes 164, 165 of the magnetic roller system 134 and the applicator roller 132.

The longitudinal axis of the magnet element 138 that intersects the rotation axis 164 is skewed relative to the straight line 166 by approximately 50° counter to the rotation direction P11 of the roller 162. The longitudinal axis of the magnet element 142 is skewed relative to the straight line 166 by approximately 100° in the rotation direction P11 of the roller 162. The longitudinal axes of the magnet elements 142 and 144 also run through the rotation axis 164 of the magnetic roller system 134.

Magnetic brushes form on the outer surface of the roller 162 due to the magnetic fields of the magnet elements 138 through 144. The separation between the outer surfaces of the roller 162 and the applicator roller 132 is set such that the magnetic brush formed by the magnetic field of the magnet element 140 in the area 150 contacts the roller surface of the applicator roller 132. The toner particles of the layer 133 are removed from the surface of the applicator roller 132 and adhere to the ferromagnetic carrier particles of the magnetic brush 150. As already specified, this event is supported by the potential difference DC generated between the surfaces of the applicator roller 132 and the roller 162 of the magnetic roller system 134 by the direct voltage source 160. The potential difference DC to be set is, as already specified in connection with FIG. 7, dependent on the toner system used.

The transport of the carrier particles between the magnet elements 138 and 140 ensues on the surface of the roller 162. The particle mixture made up of ferromagnetic carrier particles and the toner particles removed from the surface of the applicator roller 132 is transported between the magnet element 140 and the magnet element 142 via the rotation motion of the roller 162 in the direction of the arrow P11.

The magnetic fields of the magnet elements 142, 144 act in primarily the same direction, whereby the north poles N of the magnet elements 142, 144 are directed towards the surface of the roller 162. The adjacent poles N, N of the two magnet elements 142, 144 facing the particle mixture are thereby similar. The adjacent edges of these magnet elements 142, 144 are (viewed in the rotation direction) arranged at a separation in the range of 0.01 to 10 mm from one another, whereby the distance between the adjacent edges does not have to be constant.

The magnetic fields of the magnet elements 142, 144 overlap, whereby the resulting magnetic field at each point of the space of the resulting vector is an addition of the field vectors generated by the magnet elements 142, 144. In the area between the magnet elements 142, 144 on the surface of the roller 162, the field vectors have approximately the same magnitude and are directed approximately opposite, such that the resulting magnetic field strength in this area is low. The field vectors have the same magnitude at a distance absorption approximately 5 mm from the surface of the roller 162, however the directions are no longer approximately opposed. At a distance between 5 mm and 15 mm from the surface of the roller 162, on an axis of symmetry between the axes of the poles N, S of the magnet elements 142, 144, an area with high magnetic field strength and high magnetic flux density exists that is also designated as a magnetic far field.

The ferromagnetic carrier particles are pulled in the direction of high magnetic field strengths. This means that the carrier particles are pulled corresponding to the resulting magnetic field strength into the area 156 with high magnetic field strength at a distance between 5 mm and 15 mm from the surface of the roller 162. Given a rotation motion of the roller 162, carrier particles are conveyed into the area 152, then pushed into the area 156 and, in the further course, supplied to the magnetic brush in area 154, whereby in area 156 they have a separation from the surface of the roller 162 as a result of the resulting magnetic field.

The particle mixture made up of carrier particles and toner particles in the area 158 falls down from the magnetic brush 154 into a catch reservoir (not shown) (for example, into the "mixture sump" of the printer or copier) for reprocessing of the particle mixture. During the entire cleaning event, toner particles adhere to the carrier particles. The toner particles abraded from the roller surface likewise adhere to the carrier particles and are transported together with these.

A self-cleaning effect of the conductive surface of the roller 162 is achieved in the arrangement shown in FIG. 8 via the arrangement of the magnet elements 138 through 144. This self-cleaning effect is based on that, given the two adjacent magnet elements 142, 144, the north and south poles N, S are aligned in approximately the same direction, whereby a standing particle mixture is respectively generated on the surface of the roller 162 in the areas 152, 154 that abrades on the surface and loosens toner particles from it.

The resulting magnetic field has a low resulting field strength between the magnet elements 142, 144 on the surface of the roller 162. Given the rotation of the roller 162, the transport of the particle mixture ensues in the area 156 at a separation from the surface of the roller 162. The particle mixture hardens in the area of the magnetic brush 152, whereby the mixture transport is inhibited. The force with which the particle mixture made up of ferromagnetic carrier particles and electrically charged carrier particles adheres to the surface of the roller 162 is directly dependent on the magnetic field strength of the magnet elements of the magnetic roller stator 136, primarily on that of the magnet element 142.

In the areas 152, 154, the standing particle mixture adhering to the surface of the roller 162 rubs against the toner particles adhering to the surface of the roller 162. The abraded toner particles adhere to the carrier particles and fall down into area 158 with these. The thusly cleaned surface of the roller 162 ensures that the continuous electrostatic process in the printer or copier is not impaired. Furthermore, due to the friction between carrier particles and toner particles, a triboelectrical charge ensues of the toner particles partially charged by the preceding electrophotographic process.

In the magnetic far field, the north poles N of the magnet elements 142, 144 can be considered as a common north pole. The particle mixture is pulled in the direction of the far field, from the surface of the roller 162 into the area with high magnetic field strength that is, however, less than the field strength on the roller surface at the poles. The particle mixture thereby hardens on the roller surface in the areas at the poles N, N of the magnet elements 142, 144 and forms accumulations there. In these accumulations, a part of the particle mixture is pushed away from the roller surface by the conveyed particle mixture. The magnetic field strength decreases with the distance from the magnet element. The particle mixture is then pushed along by the conveyed particle mixture. The design of the magnetic roller stator 136 and the arrangement of the magnet elements 138 through 144 act on this stator 136, so that in area 158, the resulting magnetic field on the surface of the roller 162 is formed such that the particle mixture falls down.

In other embodiments, arrangements of the magnet elements are provided that enable a further transport on the roller 162 or a transfer of the particle mixture to an adjacent magnetic roller system. The separation arising of the particle mixture from the surface of the roller 162 in the area 156 is primarily dependent on the magnetic field strength of the magnet elements 142, 144, the separation of the north poles N of these magnet elements 142, 144 and the outer surface of the roller 162, the thickness and the material of the roller 162, the roughness of the roller 162, and the circumferential speed of the roller 162.

The falling off of the particle mixture in the area 158 ensues when the centrifugal force (that is caused by the rotation of the roller 162) tangential to the roller 162 prevails relative to the radially acting magnetic force on the particle mixture. A transfer to an adjacent magnetic roller system ensues when a sufficiently great magnetic flux is created by the magnet configuration between the adjacent roller system and the magnetic roller system 134.

Given a rotation motion of the rollers 132, 162, the standing particle mixture at the north poles N (acting approximately in the same direction) of the magnet elements 142, 144 is replaced by newly supplied particle mixture, and thus continuously exchanged. A continuous enrichment of the of the standing particle mixture with toner does not ensue. To reduce the necessary mechanical energy acting on the particle mixture during the cleaning process, the roller 162 can be provided with a coating that has a very low surface energy, for example with Teflon. However, no sealed coating should be used that is electrically insulating in order to prevent the electrostatic process. For charge transport from and to the roller 162, its surface must be electrically conductive.

In alternative embodiments, highly insulating materials with low surface energy can also be introduced into the recesses of a rough surface structure of the roller 162. The remaining conductive areas of the roller 162 then ensure the necessary charge flow. In the arrangement shown in FIG. 8, no additional devices are necessary to remove toner residues on the roller 162. A very compact assembly of the overall system is thus possible. Additional auxiliary energy to clean the roller 162 is unnecessary. The arrangement does not need wearing parts or consumable materials. It is thereby low-maintenance.

This arrangement can be used for various toner types that have different toner parameters. In another embodiment, the arrangement shown in FIG. 8 for cleaning a magnetic roller 162 is used that serves to ink a surface. Incorrectly charged toner particles can be comprised in the particle mixture for inking. Due to the force acting on these toner particles via a potential difference, these toner particles are not transported to the surface to be inked, but rather adhere via this force to the surface of the magnetic roller 162 on which they then form an electrically insulating layer. The formation of such a layer is prevented by the inventive cleaning of this magnetic roller 162.

Figure 9:
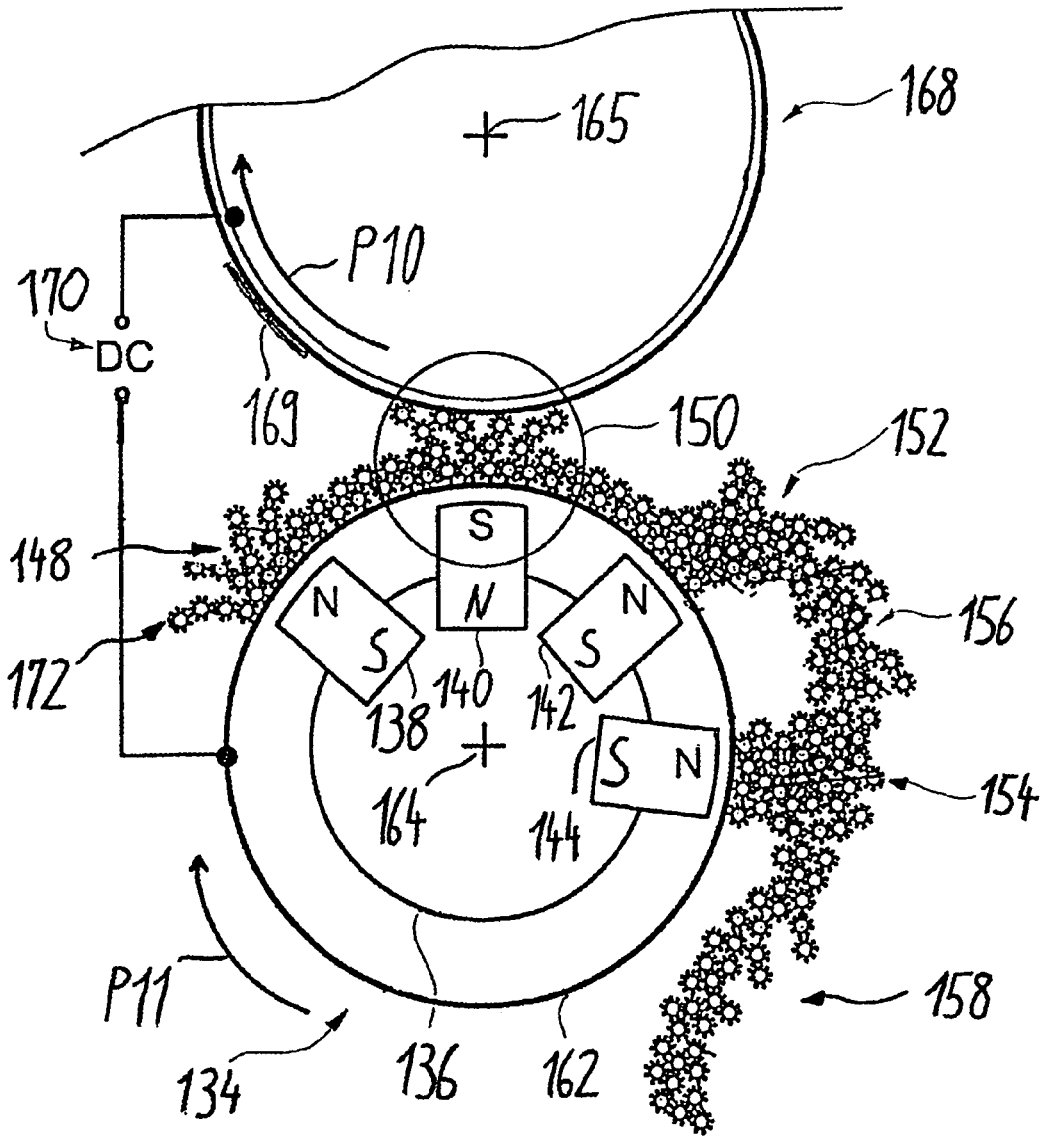
FIG. 9 is a pictorial side view of an arrangement to remove toner particles from a magnetic roller with the aid of a magnet arrangement made up of two magnet elements, whereby the magnetic roller serves to develop a latent charge image on a photoconductor.

An arrangement to ink a latent charge image arranged on a photoconductor drum 168 in an electrophotographic printer or copier is shown in FIG. 9. The arrangement is substantially designed as the arrangement shown in FIG. 8 for cleaning the applicator roller 132. Identical elements have the same reference characters. The photoconductor drum 168 is moved in the direction of the arrow P10 and is arranged at a distance from a magnetic roller system 134. The assembly of the magnetic roller system 134 was already specified in connection with FIG. 8.

In the arrangement shown in FIG. 9, in the area 172, a two-component mixture (meaning a particle mixture made up of toner particles and carrier particles) is supplied that has a high weight proportion of toner particles, in the range of 2% to 8%. In the area 150, the magnetic field of the magnet element 140 forms a magnetic brush (made up of the two-component mixture) that contacts the surface of the photoconductor drum 168. A latent charge image is located on this surface of the photoconductor drum 168, in that the areas to be inked with toner have a high potential difference DC relative to the surface of the roller 162. Via this potential difference DC, the toner particles are detached from the surface of the roller 162 and attached to the surface of the photoconductor drum 168.

A part of the toner particles of the two-component mixture that is supplied to the arrangement in area 172 is directly applied to the surface of the roller 162 and forms a toner layer on the surface of the roller 162. Toner particles are also applied to the surface of the roller 162 via the force effects (already specified) of electrical fields on the toner particles, for example in the background area and given incorrectly charged toner particles. Via roller-shaped rotating motions within the particle mixture, the standing particle mixture in the areas 152, 154 rubs against the surface of the roller 162. The toner particles on the surface are rubbed off, as already specified in connection FIG. 8. The formation of the standing particle mixture, the transport and the falling off of the particle mixture in the area 158 likewise ensues as in the arrangement shown in FIG. 8. Given the arrangement shown in FIG. 9, in particular possible are such embodiments that have already been specified in connection with FIG. 8. The "memory effect" is effectively prevented via the cleaning of the roller 162 in an electrophotographic printer or copier with an arrangement according to FIG. 9.

Figure 10:
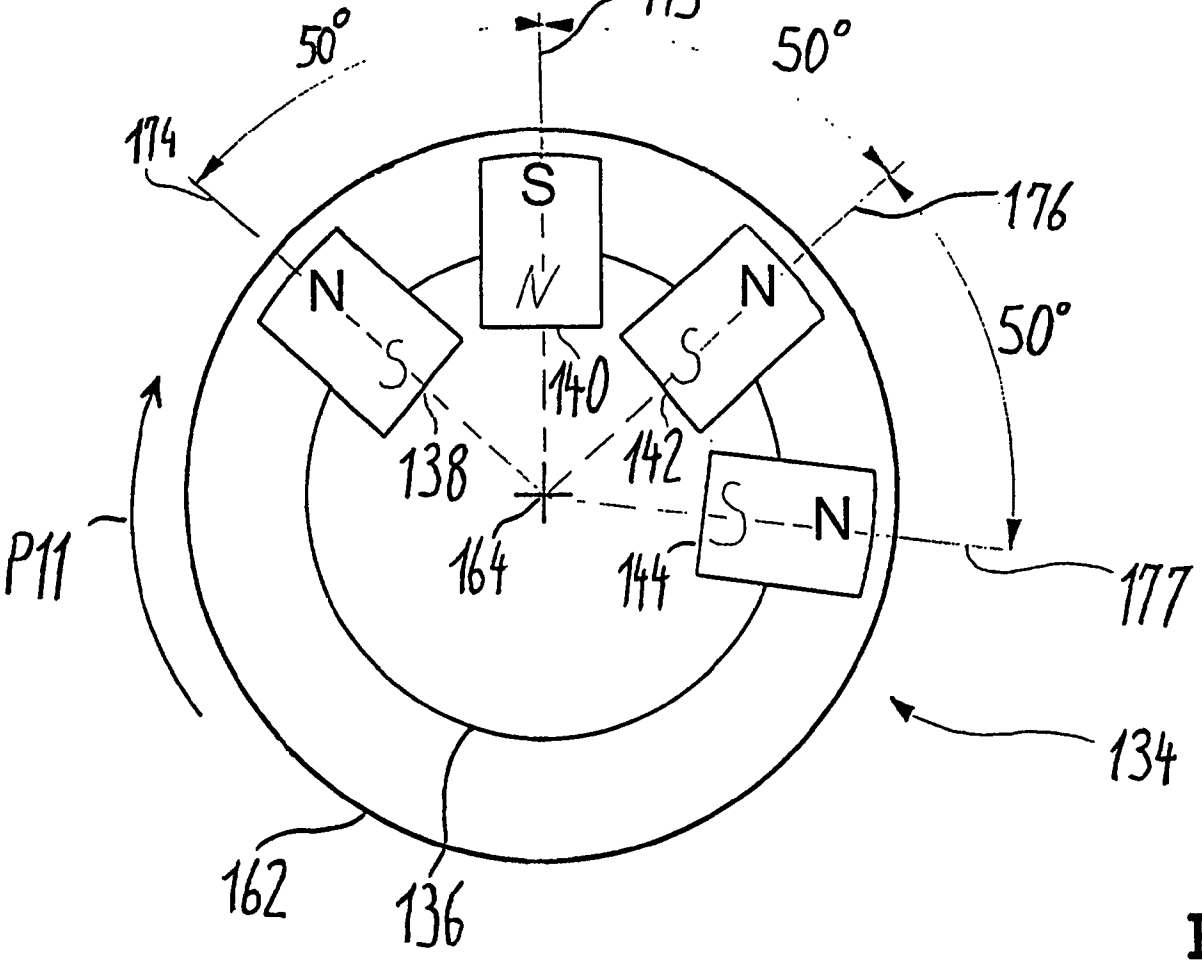
FIG. 10 is a pictorial side view of an exemplary embodiment for the configuration of the magnet stator of the roller system from FIG. 9 to achieve the cleaning effect on the roller surface.

In FIG. 10, the magnetic roller system 134 according to FIGS. 8 and 9 is shown in an enlarged representation. The angles encompassed between the axes 174 through 177 of the poles N, S of the magnet elements 138 through 144 are specified. The axes 174 through 177 of the magnet elements 138 through 144 respectively have an angular separation of approximately 5° from one another. The magnetic field strength of the magnet elements 142, 144, the overall size of the magnet elements 142, 144, and the absolute separation between the two magnet elements 142, 144 are to be considered in the setting of the angular separation between the axes 176, 177 of the poles N, S of the identically aligned magnet elements 142, 144. In other embodiments, the angle to be set can also accordingly have a value deviating significantly from 50°: for example, this angle can be in the range between 10° and 100°.

Figure 11:
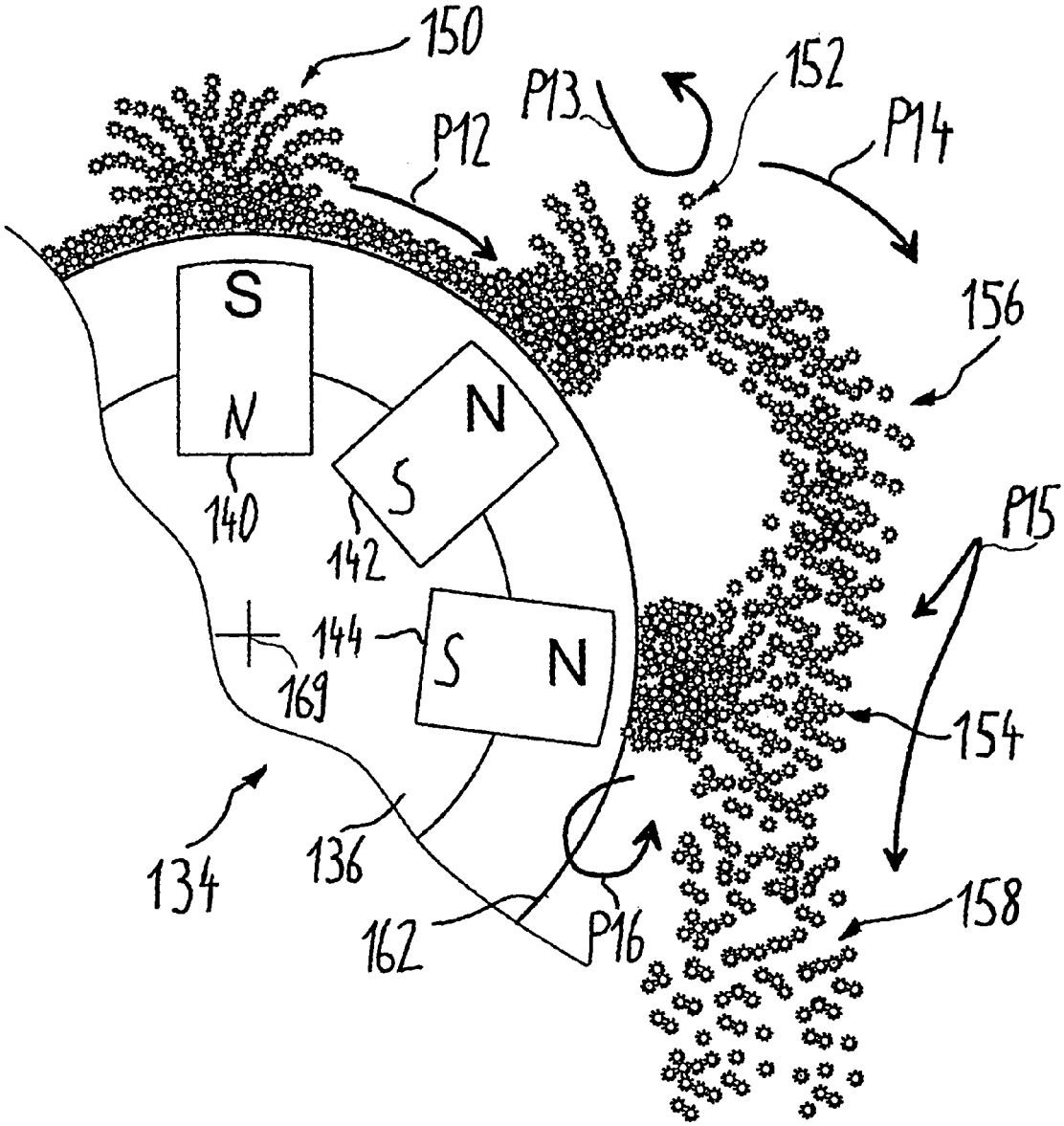
FIG. 11 is a pictorial side view of the formation of magnetic brushes on the magnet elements, as well as the movements within the particle mixture on the roller surface that are indicated by the arrows next to the mixture.

A section of the magnetic roller system 134 is shown in FIG. 11 together with the particle mixture made up of toner particles and carrier particles given a rotation motion of the roller 162. The motions of the particle mixture are recognizable using the arrows P12 through P16. The particle mixture is transported from the south pole S of the magnet element 140 to the north pole N of the magnet element 142 in the arrow direction of the arrow P12 on the surface of the roller 162 via its rotation motion. As already specified, the north poles N of the magnet elements 142, 144 pointing in approximately the same direction lead to the stationary particle mixture in the area of the north pole N of the magnet element 142 on the surface of the roller 162.

As a result of the amount of the particle mixture conveyed in the arrow direction P12 on the surface of the roller 162, and via its rotation motion, a rotating, roller-shaped motion and a roller-shaped swirling and mixing is created within the standing particle mixture on the surface of the roller 162 in the area 152. The motion of the particle mixture in the area 152 is visible via the arrow P13. The parts of the standing particle mixture (that, in the magnetic far field in the outer area 152 of the magnetic brush, are pushed away by the increasing accumulation of the particle mixture and that, as already specified, are pulled in the direction of the arrow P14 into the mutual magnetic far field of the magnet elements 142, 144) have in area 156 a separation from the surface of the roller 162, whereby the particle mixture is transported through the area 156 towards the area 154 by the continuous conveyance in the area 152 in the direction of the arrow P14.

Corresponding to the arrow P15, a part of the particle mixture is supplied to the area 154 in front of the north pole N of the magnet element 144 at a distance from the surface of the roller 162 in the area 156. The remaining part falls directly into a catch reservoir (not shown), for example into a mixture sump of the printer or copier. The magnetic field of the magnet element 144 also generates a standing particle mixture on the surface of the roller 162 in the area 154, whereby a rotating, roller-shaped motion also ensues there in the particle mixture, via which toner particles are abraded from the surface of the roller 162. This rotating motion within the standing particle mixture is represented by the arrow P16.

The continuous feed of the particle mixture in the area 154 effects an accumulation of particles in this area 154. Particles in areas with low magnetic field strength are hereby pushed outwards, meaning away from the roller surface. The force effect of the magnetic field decreases with increasing distance from the magnet element 144, and a part of the particle mixture in the outer area 154 of the magnetic brush falls down as a result of gravity. The particle mixture falling down is shown in area 158.

In an alternative exemplary embodiment, the north and south poles N, S of the magnet elements 142, 144 are arranged opposite to the alignment shown in FIG. 11, meaning the south poles S of the magnet elements 142, 144 act in approximately the same direction and are facing the surface of the roller 162. The arrangements according to FIGS. 1 through 11 are sectional representations of roller arrangements. The magnet elements shown therein are preferably arranged on the total width of the respective magnetic roller. The width of the magnetic roller is thereby preferably larger than or equal to the possible print width of the printer or copier.

The magnet elements can also be comprised of a plurality of individual magnets. The axis through the poles N, S of the magnet elements is designated in the figure specifications as the longitudinal axis of the magnet elements. Via the design layout, in further embodiments, the opposite poles N, S of the poles N, S facing the particle mixture do not act in the opposite direction. The shape of the raised accumulations of the particle mixture, meaning of the magnetic brushes and the standing particle mixture, are influenced by this design layout. In this exemplary embodiment, the poles N, N act approximately in the radial direction.

Figure 12:
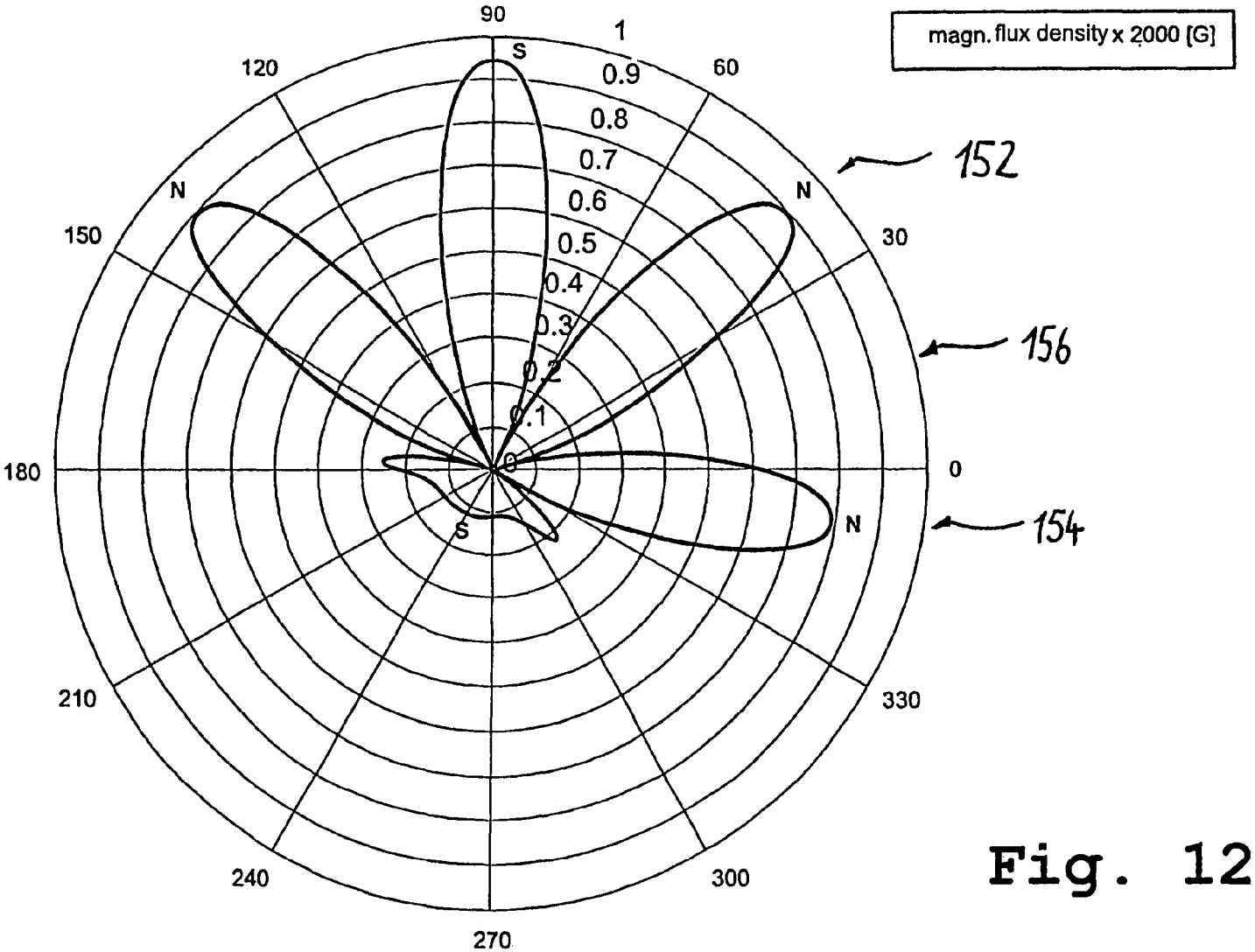
FIG. 12 is a flux density graph illustrating the field distribution in the magnetic near field directly on the roller surface of the magnetic roller system shown in FIG. 10.

In FIG. 12, the field distribution in the magnetic near field directly on the surface of the roller 162 of the magnetic roller system 134 is shown in a polar coordinate system. The magnetic flux density is plotted on the axis of the polar coordinate system. Given a multiplication by 2000, the specified number values of 0 to 1 specify the magnetic flux density in Gauss. Given a multiplication by 0.2, these number values specify the magnetic flux density in Tesla. The longitudinal axis through the magnet element 140 is the 90° axis in the diagram.

The alignment of the resulting magnetic field that generates the magnetic flux density is characterized by the letters N and S arranged near the curves in the diagram. The flux density is directly proportional to the magnetic field strength, whereby the magnetic flux density is the product of the absolute permeability and magnetic field strength. In the area 152, the magnet element 142 shown in FIG. 11 generates a maximum magnetic flux density of 1800 Gauss on the surface of the roller 162. The magnet element 144 likewise shown in FIG. 11 generates a maximum flux density of approximately 1780 Gauss on the surface of the roller 162. A minimum resulting flux density of approximately 100 Gauss results in the area 156.

Figure 13:
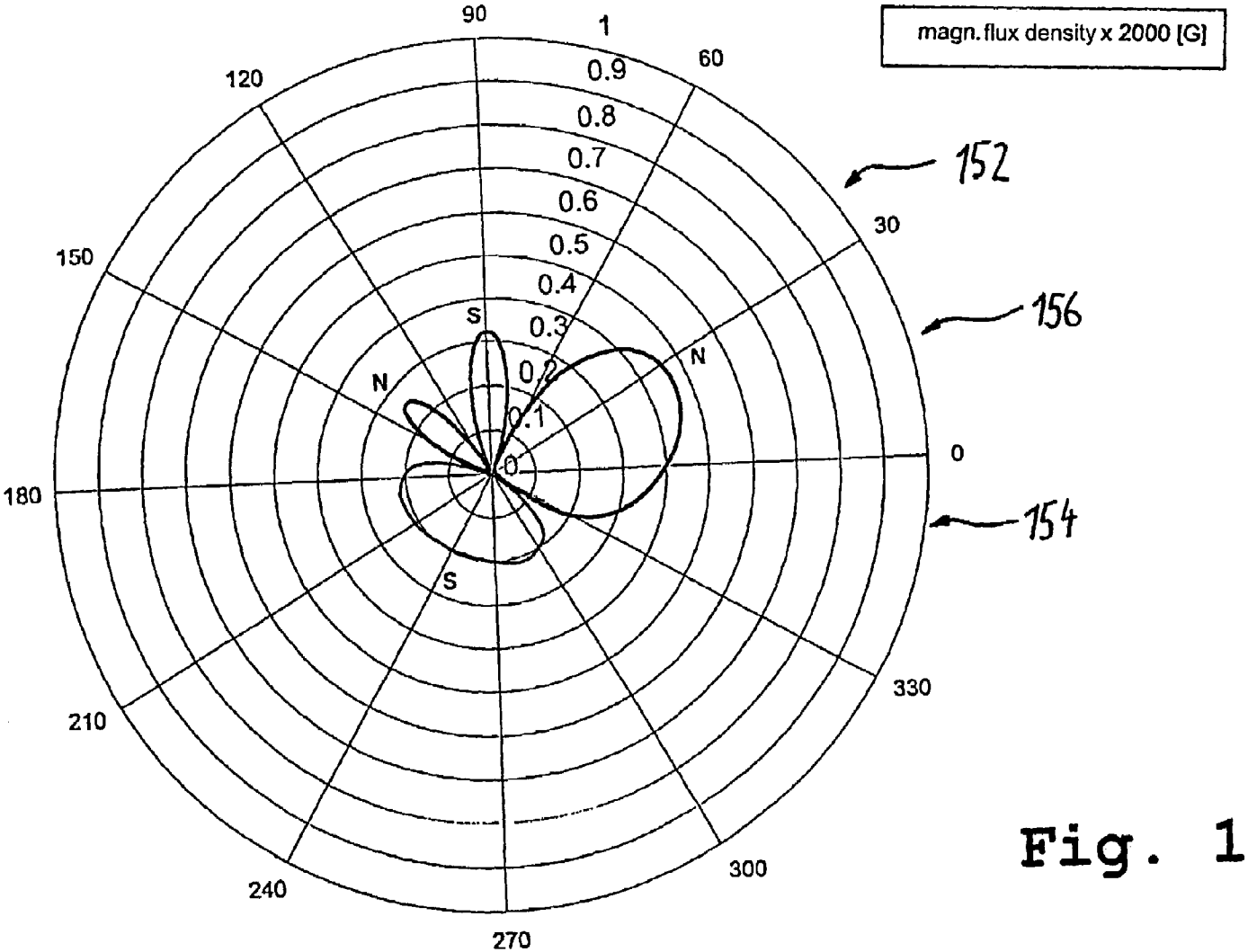
FIG. 13 is a flux density graph illustrating the field distribution in the magnetic far field at the distance of approximately 9 mm from the roller surface of the magnetic roller system shown in FIG. 10.

The field distribution in the magnetic far field is shown in FIG. 13 at a distance of approximately 9 mm from the surface of roller 162. The scale gradation coincides with the scale gradation of the diagram shown in FIG. 12. In the diagram shown in FIG. 13, the magnetic far field in the area 156 between the magnet elements 142, 144 at a distance of approximately 9 mm from the surface of the roller 162 has a relatively high magnetic flux density of up to 950 Gauss. The maximum difference of the magnetic flux density in the area 156 between the surface and an area at a distance of 9 mm from the surface amounts to 850 Gauss. Thus, at a distance of 9 mm in the area 156, the magnetic field is stronger by a multiple than at the surface of the roller 162. Due to the strong magnetic far field, the detachment of the particle mixture from the surface of the roller 162 ensues as specified in the area 156 and the standing particle mixtures in the areas 152, 154.

Additionally, the arrangement specified in FIGS. 8 and 9 can be provided in other exemplary embodiments with a scraper that, for example, is arranged at a predetermined distance (viewed in the rotation direction of the roller 162) after the magnet element 144. Thus, in further embodiments, the arrangements shown in FIGS. 8 and 9 can be combined with elements of the arrangements shown in FIGS. 4 and 5. All magnet elements can be implemented depending on the requirements for the field strength and on the embodiment as a electromagnets or as permanent magnets. The arrangements shown in FIGS. 4 and 5 or 8 and 9 for the application of toner and to clean surfaces can also be used in arrangements that are designed like the arrangements shown in FIGS. 1 and 2.

In all embodiments, it is possible to overlap the potential differences DC generated by the direct voltage sources with potential differences generated by alternating voltage sources. If a plurality of direct voltage sources are provided in an embodiment, potential differences generated even individually by these direct voltage sources can also be overlapped with potential difference generated by one or by many alternating voltage sources. The potential difference generated by the alternating voltage source effects a motion and thereby a loosening of the toner particle accumulation in the two-component mixture.

Although preferred exemplary embodiments are shown and details in the drawings and in the preceding specification, these should be viewed as purely exemplary and not as limiting the application. It is to be noted that only the preferred exemplary embodiments are shown and described, and all changes and modifications that lie within the scope of protection of the invention in the present and future should be protected.

Embodiments of the present invention may be described in terms of functional block components and various processing steps. Such functional blocks may be realized by any number of hardware components configured to perform the specified functions. For the sake of brevity, conventional aspects and elements may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical".

Reference List

10 roller arrangement
12 applicator roller; first carrier element
13 photoconductor element; second carrier element
14 first magnetic roller arrangement; toner application unit
16 second magnetic roller arrangement; cleaning unit
18 magnetic brush
20 prepared two-component mixture
22 dosing scraper
24 rotating hollow roller
26 magnetic roller stator
28, 30, 32, 34 permanent magnet
36 toner layer
38, 40, 42 toner residues
44 rotating hollow roller
46 magnetic roller stator
48, 50, 52 permanent magnets
54 area of the transfer of the particle mixture
56, 58, 60 area with magnetic brush
62 particle mixture falling down
64 roller arrangement
66 guide element
68, 70 rotation axis
72, 74, 76 direct voltage sources
77 photoconductor drum
78 applicator roller
79 toner layer
80 magnetic roller system
81 rotating hollow roller
82 scraper
84 magnetic roller stator
86, 88, 90, 92, 94, 96, 98, 100 permanent magnet
102 supplied particle mixture
104, 106, 108, 110 area with magnetic brush
112 standing particle mixture
114 falling particle mixture
116 direct voltage source
118 toner particle layer
120 supplied particle mixture
122 direct voltage source
123, 124, 125, 126 normal through poles
127 rotation axis
128 area with magnetic brush
130 standing particle mixture
132 applicator roller
133 toner layer
134 magnetic roller system
136 magnetic roller stator
138, 140, 142, 144 magnet element
146 supplied carrier particles
148, 150, 152, 154 area with magnetic brush
156 area with particle mixture raised from the roller surface
158 shed particle mixture
160 direct voltage source
162 rotating hollow roller
164, 165 rotation axis
166 normal through poles
168 photoconductor drum
169 inked area of the latent charge image
170 direct voltage source
172 area for feeding of the particle mixture
174, 175, 176, longitudinal axis of the magnet element 177
P1 through P16 direction arrows P16

The invention claimed is:

1. An electrophotographic print or copy device, comprising:

a first carrier element;

a toner application unit that transfers toner particles onto the first carrier element aided by a particle mixture made up of electrically charged toner particles and ferromagnetic carrier particles;

a second carrier element to which at least one part of the toner particles of the particle mixture are transferred;

a cleaning unit for accepting the particle mixture after the transfer of at least one part of the toner particles to the second carrier element, the cleaning unit accepting, with the aid of the supplied particle mixture, the toner particles present on the first carrier element; and a guide element arranged between toner application unit and cleaning unit that is utilized in the transfer of the particle mixture from the toner application unit to the cleaning unit.

2. The electrophotographic print or copy device according to claim 1:

wherein a magnetic field of at least one magnet element is utilized for transfer of the particle mixture from the toner application unit to the cleaning unit.

3. An electrophotographic print or copy device, comprising:

a first carrier element having an outer surface;

a toner application unit configured to apply electrically charged toner particles to the surface of the first carrier element;

a second carrier element to which at least one part of the toner particles is transferred from the first carrier element;

a cleaning unit configured to remove, from the first carrier element, the toner particles remaining on the first carrier element after the transfer, the cleaning unit comprising:

a roller that is arranged at a distance from the first carrier element, the roller having a surface upon which is conveyed a particle mixture that comprises electrically charged toner particles and ferromagnetic carrier particles;

at least one magnet element arranged stationary inside the roller;

a scraper arranged at a distance from the roller surface;

the at least one magnet element being arranged in proximity to the scraper such that the carrier particles form at least one raised accumulation on the surface of the roller, and are configured to abrade, given a rotation motion of the roller, on its surface; and a guide element arranged between toner application unit and cleaning unit that is utilized in the transfer of the particle mixture from the toner application unit to the cleaning unit.

4. The device according to claim 3, wherein the at least one raised accumulation, via forces acting on the carrier particles via the resulting magnetic field of the two magnet elements detach at least a part of the carrier particles from the roller surface in a sub-area between the magnet elements, and that, given a rotation motion of the roller, the particles of the particle mixture in the area of the magnet elements are moved such that they abrade on the surface of the roller.

5. The device according to claim 4, wherein at least one part of the toner particles that are electrostatically attached to an outer circumferential surface of the roller are rubbed off of this via the motion of the particle mixture.

6. The device according to claim 3, further comprising further magnet elements whose poles are respectively aligned radially relative to the roller are arranged inside the roller.

7. The device according to claim 3, further comprising a scraper that is arranged at a distance in the range of 0.1 to 0.4 mm from the roller surface.

8. The device according to claim 7, wherein, when viewed in a rotation direction of the roller, the first and second magnet element are arranged in front of the scraper in proximity to it.

9. The device according to claim 7, wherein the scraper is arranged in a lower roller half.

10. The device according to claim 3, wherein the outer circumferential surface of the roller has a roughness in the range of 1 to 5000 μm.

11. The device according to claim 3, wherein the roller surface comprises at least one of aluminum, chromium, nickel, copper, conductive plastic and a plastic with a conductive layer.

12. The device according to claim 3, wherein the surface of the roller is a flame-spraying-method-formed surface.

13. The device according to claim 3, wherein the magnet elements are permanent magnets.

14. The device according to claim 3, further comprising:

a scraper arranged proximate to the magnetic element in a manner such that the carrier particles form a raised accumulation on the surface of the roller, a rotation motion of the roller causing the carrier particles abrade on its surface.

15. The device according to claim 14, wherein:

when viewed in the rotation direction of the roller, the magnet element is arranged in front of the scraper in its proximity; and the scraper is configured to strip off at least one part of the particle mixture located on the roller surface.

16. The device according to claim 15, wherein a magnetic field of the magnet element holds, in the area of the scraper, parts of the particle mixture stripped by the scraper, and wherein movements in the particle mixture in an area of the scraper are generated via the rotation motion of the roller and via the scraper positioned such that it is fixed.

17. The device according to claim 16, wherein at least one part of the toner particles that adhere to the outer surface of the roller are detached from this via motions in the particle mixture.

18. The device according to claim 14, wherein an axis of poles of the magnet element is aligned radially relative to a rotation axis of the roller.

19. The device according to claim 14, further comprising:

a plurality of magnet elements that are arranged inside the roller, and axes of the poles of the magnets are respectively aligned radially relative to the roller, the poles of adjacent magnet elements having opposite effective directions.

20. The device according to claim 14, wherein the scraper is arranged in the lower roller half.

21. The device according to claim 14, wherein the outer circumferential surface of the roller has a roughness in a range of 1 to 5000 μm.

22. The device according to claim 14, wherein the roller surface comprises at least one of aluminum, chromium, nickel, copper, conductive plastic and a plastic with a conductive layer.

23. The device according to claim 14, wherein the surface of the roller is a flame-spraying-method-formed surface.

24. The device according to claim 14, wherein the at least one magnet element is a permanent magnet.

25. The device according to claim 14, wherein a distance in the range of 0.1 to 0.4 mm is set between the scraper and the roller surface.

26. The device according to claim 3, wherein at least one of the first and the second carrier element is a roller or a band.

27. The device according to claim 3, wherein the first carrier element is a photoconductor and the second carrier element is a carrier material to be printed or a transfer element.

28. The device according to claim 3, wherein the cleaning unit comprises a roller whose rotation direction is the same as the rotation direction of the first carrier element.

29. The device according to claim 28, further comprising a magnet element arranged stationary inside the roller at a location with a minimal distance between the first carrier element and roller, the axis of the poles of the magnet element running radially relative to the roller.

30. The device according to claim 29, further comprising a plurality of magnet elements arranged inside the roller, an axis of the poles of each magnet element being aligned radially relative to the rotation axis.

31. The device according to claim 29, wherein the magnet element is a permanent magnet.

32. The device according to claim 3, wherein an amount of the ferromagnetic carrier particles conveyed on the roller surface of the cleaning unit comprises a predetermined proportion of toner particles.

33. The device according to claim 3, wherein the guide element is a guide sheet.

34. The electrophotographic print or copy device as claimed in claim 3, wherein a magnetic field of the at least one magnet element is utilized for transfer of the particle mixture from the toner application unit to the cleaning unit.

35. The electrophotographic print or copy device as claimed in claim 3:

wherein the first carrier element is an applicator element and the second carrier element is a photoconductor.

36. An electrophotographic print or copy device, comprising:

a first carrier element having an outer surface;

a toner application unit configured to apply electrically charged toner particles to the surface of the first carrier element;

a second carrier element to which at least one part of the toner particles is transferred from the first carrier element;

a cleaning unit configured to remove, from the first carrier element, the toner particles remaining on the first carrier element after the transfer, the cleaning unit comprising:

a roller that is arranged at a distance from the first carrier element, the roller having a surface upon which is conveyed a particle mixture that comprises electrically charged toner particles and ferromagnetic carrier particles;

at least two magnet elements arranged stationary inside the roller;

a scraper arranged at a distance from the roller surface; and a guide element arranged between toner application unit and cleaning unit that is utilized in the transfer of the particle mixture from the toner application unit to the cleaning unit;

wherein adjacent poles of both magnet elements facing the particle mixture are uniform and are arranged (viewed in a rotation direction of the roller) at a distance from one another such that the carrier particles on the surface of the roller form, at the magnet elements, at least one raised accumulation whose carrier particles abrade on the surface of the roller given a rotation motion of the roller; and wherein a magnetic field of the at least one magnet element is utilized for transfer of the particle mixture from the toner application unit to the cleaning unit.

37. An electrophotographic print or copy device, comprising:

a first carrier element having an outer surface;

a toner application unit configured to apply electrically charged toner particles to the surface of the first carrier element;

a second carrier element to which at least one part of the toner particles is transferred from the first carrier element;

a cleaning unit configured to remove, from the first carrier element, the toner particles remaining on the first carrier element after the transfer, the cleaning unit comprising:

a roller that is arranged at a distance from the first carrier element, the roller having a surface upon which is conveyed a particle mixture that comprises electrically charged toner particles and ferromagnetic carrier particles;

at least two magnet elements arranged stationary inside the roller;

a scraper arranged at a distance from the roller surface;

wherein adjacent poles of both magnet elements facing the particle mixture are uniform and are arranged (viewed in a rotation direction of the roller) at a distance from one another such that the carrier particles on the surface of the roller form, at the magnet elements, at least one raised accumulation whose carrier particles abrade on the surface of the roller given a rotation motion of the roller;

the device further comprising:

a guide element arranged between toner application unit and cleaning unit that is utilized in the transfer of the particle mixture from the toner application unit to the cleaning unit.

38. A method to operate an electrophotographic print or copy device, comprising:

applying electrically charged toner particles to a surface of a first carrier element aided by a toner application unit;

transferring at least one part of the toner particles from the first carrier element to a second carrier element;

removing, aided by a cleaning unit, the toner particles remaining on the first carrier element after the transfer from the first carrier element, the cleaning unit comprising a roller that is arranged at a distance from the first carrier element, with at least two magnet elements arranged stationary inside the roller;

conveying a particle mixture that comprises electrically charged toner particles and ferromagnetic carrier particles on a surface of the roller;

forming at least one raised accumulation of the carrier particles on the surface of the roller at the magnet elements, adjacent poles of both magnet elements facing the particle mixture being uniform and being arranged (viewed in the rotation direction of the roller) at a distance from one another to create the at least one raised accumulation, rotating the roller;

abrading, with the carrier particles, on the surface of the roller given the rotation of the roller; and providing a guide element arranged between toner application unit and cleaning unit that is utilized in the transfer of the particle mixture from the toner application unit to the cleaning unit;

wherein the first carrier element is an applicator element and the second carrier element is a photoconductor.

39. A method to operate an electrophotographic print or copy device, comprising:

applying electrically charged toner particles to a surface of a first carrier element aided by a toner application unit;

transferring at least one part of the toner particles from the first carrier element to a second carrier element;

removing, aided by a cleaning unit, the toner particles remaining on the first carrier element after the transfer from the first carrier element, the cleaning unit comprising a roller that is arranged at a distance from the first carrier element, with at least two magnet elements arranged stationary inside the roller;

conveying a particle mixture that comprises electrically charged toner particles and ferromagnetic carrier particles on a surface of the roller;

forming at least one raised accumulation of the carrier particles on the surface of the roller at the magnet elements, adjacent poles of both magnet elements facing the particle mixture being uniform and being arranged (viewed in the rotation direction of the roller) at a distance from one another to create the at least one raised accumulation, rotating the roller;

abrading, with the carrier particles, on the surface of the roller given the rotation of the roller; and providing a guide element arranged between toner application unit and cleaning unit that is utilized in the transfer of the particle mixture from the toner application unit to the cleaning unit;

wherein a magnetic field of the at least one magnet element is utilized for transfer of the particle mixture from the toner application unit to the cleaning unit.

40. A method to operate an electrophotographic print or copy device, comprising:

applying electrically charged toner particles to a surface of a first carrier element aided by a toner application unit;

transferring at least one part of the toner particles from the first carrier element to a second carrier element;

removing, aided by a cleaning unit, the toner particles remaining on the first carrier element after the transfer from the first carrier element, the cleaning unit comprising a roller that is arranged at a distance from the first carrier element, with at least two magnet elements arranged stationary inside the roller;

conveying a particle mixture that comprises electrically charged toner particles and ferromagnetic carrier particles on a surface of the roller;

forming at least one raised accumulation of the carrier particles on the surface of the roller at the magnet elements, adjacent poles of both magnet elements facing the particle mixture being uniform and being arranged (viewed in the rotation direction of the roller) at a distance from one another to create the at least one raised accumulation, rotating the roller;

abrading, with the carrier particles, on the surface of the roller given the rotation of the roller; and providing a guide element arranged between toner application unit and cleaning unit that is utilized in the transfer of the particle mixture from the toner application unit to the cleaning unit.

41. The method according to claim 40, further comprising:

absorbing the toner particles present on the first carrier element with the aid of the cleaning unit.

42. An electrophotographic print or copy device, comprising:

a first carrier element;

a toner application unit that transfers toner particles onto the first carrier element aided by a particle mixture made up of electrically charged toner particles and ferromagnetic carrier particles;

a second carrier element to which at least one part of the toner particles of the particle mixture are transferred; and a cleaning unit for accepting the particle mixture after the transfer of at least one part of the toner particles to the second carrier element, the cleaning unit accepting, with the aid of the supplied particle mixture, the toner particles present on the first carrier element; and at least one of a first voltage source configured to provide a first potential difference between the toner application unit and the first carrier element, and a second voltage source configured to provide a second potential difference between the cleaning unit and the first carrier element;

wherein the electrostatically charged toner particles are electrically negatively charged, that the potential of the first carrier element is positive relative to the potential of the toner application unit, and negative relative to the potential of the cleaning unit.

43. An electrophotographic print or copy device, comprising:

a first carrier element;

a toner application unit that transfers toner particles onto the first carrier element aided by a particle mixture made up of electrically charged toner particles and ferromagnetic carrier particles;

a second carrier element to which at least one part of the toner particles of the particle mixture are transferred; and a cleaning unit for accepting the particle mixture after the transfer of at least one part of the toner particles to the second carrier element, the cleaning unit accepting, with the aid of the supplied particle mixture, the toner particles present on the first carrier element; and at least one of a first voltage source configured to provide a first potential difference between the toner application unit and the first carrier element, and a second voltage source configured to provide a second potential difference between the cleaning unit and the first carrier element;

wherein the electrostatically charged toner particles are electrically positively charged, that the potential of the first carrier element is negative relative to the potential of the toner application unit, and positive relative to the potential of the cleaning unit.

* * * * *